US008950599B2

(12) United States Patent
Wilder

(10) Patent No.: US 8,950,599 B2
(45) Date of Patent: Feb. 10, 2015

(54) ROTATING ORGANIZER USING JARS OR OTHER CONTAINERS FOR STORAGE

(76) Inventor: Bruce Gary Wilder, Frisco, TX (US)

( * ) Notice: Subject to any disclaimer, the term of this patent is extended or adjusted under 35 U.S.C. 154(b) by 270 days.

(21) Appl. No.: 13/552,632

(22) Filed: Jul. 18, 2012

(65) Prior Publication Data

US 2013/0180939 A1 Jul. 18, 2013

Related U.S. Application Data

(63) Continuation-in-part of application No. 12/564,916, filed on Sep. 22, 2009, now abandoned.

(51) Int. Cl.

| | |
|---|---|
| ***A47B 73/00*** | (2006.01) |
| ***A47B 49/00*** | (2006.01) |
| ***A47F 5/00*** | (2006.01) |
| ***B25H 3/02*** | (2006.01) |
| ***B25H 3/06*** | (2006.01) |

(52) U.S. Cl.

CPC ..... *A47B 49/00* (2013.01); *A47F 5/0037* (2013.01); *B25H 3/025* (2013.01); *B25H 3/06* (2013.01)

USPC ..... 211/77; 211/78

(58) Field of Classification Search

CPC ..... A47J 47/16; A47F 5/02; A47F 5/03; A47F 5/025; A47F 5/0037; A47F 5/05; A47F 7/283; A47B 49/002; A47B 49/00; B25H 3/02

USPC ..... 211/77, 78, 76, 163, 1.52, 53, 56, 95, 211/75, 84, 70, 85.18, 58, 164; D7/600.2, D7/600.3; 108/94; 312/266, 267, 97.1, 312/305; 248/200.1, 644

See application file for complete search history.

(56) References Cited

U.S. PATENT DOCUMENTS

| | | | | | |
|---|---|---|---|---|---|
| 1,732,298 | A | | 2/1925 | Arthur | |
| 1,732,131 | A | * | 10/1929 | Mahaffey | 211/77 |
| 1,927,283 | A | * | 9/1933 | Hernandez | 211/78 |
| 2,436,289 | A | * | 2/1948 | Carlson | 211/77 |
| 2,557,801 | A | * | 6/1951 | Shapiro | 211/75 |
| 2,936,901 | A | * | 5/1960 | Siemantel | 211/77 |
| 2,944,761 | A | * | 7/1960 | Best | 242/139 |
| 3,337,082 | A | * | 8/1967 | Dorgelys | 220/23.4 |
| 3,620,363 | A | | 11/1971 | Donnithorne | |
| 3,674,155 | A | | 7/1972 | Kessler | |
| 3,805,965 | A | | 4/1974 | Champagne | |
| 3,921,948 | A | * | 11/1975 | Long | 248/220.41 |

(Continued)

FOREIGN PATENT DOCUMENTS

FR 2 676 341 A1 11/1992

*Primary Examiner* — Patrick Hawn

(74) *Attorney, Agent, or Firm* — Swift & Swift; Stephen Christopher Swift

(57) ABSTRACT

An organizer that may be mounted on either a wall, wall to ceiling, ceiling, or many other ways, using limited space, and using jars or other containers for storage. Rotatable or cylindrical elongated attachment members allow the organizer to be attached to different surfaces. It has slats to which containers can be removably attached. The slats may be fixed in place, or one or more of the slats may be rotatable. If jars are used, their lids are fastened to the slats, and the jars can be opened by unscrewing them from their lids. There are handles on one end to rotate the storage system. A ratchet can prevent slipping. Because they are transparent, the containers allow the user to visually select what he or she is looking for. These containers can hold anything from hobby supplies to nuts and bolts. Potential applications range from garage organizing to commercial applications.

5 Claims, 35 Drawing Sheets

(56) References Cited

U.S. PATENT DOCUMENTS

| | | | | | |
|---|---|---|---|---|---|
| D264,604 | S | | 5/1982 | Sussman | |
| D278,585 | S | | 4/1985 | Oldham | |
| 4,534,530 | A | * | 8/1985 | Danko | 248/239 |
| 4,548,327 | A | * | 10/1985 | Kilkelly | 211/187 |
| 4,601,628 | A | | 7/1986 | Lowing | |
| 4,735,325 | A | * | 4/1988 | Remmers | 211/187 |
| 4,852,748 | A | * | 8/1989 | Burgess et al. | 211/70.6 |
| 4,895,260 | A | * | 1/1990 | Ancona et al. | 211/77 |
| D320,141 | S | * | 9/1991 | Farrell | D7/600.2 |
| 5,069,361 | A | | 12/1991 | Jeffway, Jr. et al. | |
| 5,083,670 | A | | 1/1992 | Zimmer | |
| D329,573 | S | | 9/1992 | Picard | |
| 5,228,582 | A | * | 7/1993 | Marshall et al. | 211/163 |
| 5,248,049 | A | | 9/1993 | Murphy, Sr. | |
| D347,769 | S | | 6/1994 | Kibbe | |
| 5,368,203 | A | * | 11/1994 | Friedrich et al. | 222/179.5 |
| D369,710 | S | * | 5/1996 | Picard et al. | D6/559 |
| 6,029,828 | A | * | 2/2000 | Robbins et al. | 211/78 |
| 6,056,132 | A | * | 5/2000 | Becker et al. | 211/164 |
| 6,234,326 | B1 | * | 5/2001 | Higgins et al. | 211/74 |
| D488,643 | S | | 4/2004 | Birmingham | |
| 7,207,448 | B1 | | 4/2007 | Marino, Jr. | |
| D542,583 | S | * | 5/2007 | Watchowski et al. | D6/553 |
| 7,275,647 | B1 | * | 10/2007 | Thompson | 211/85.18 |
| 8,132,768 | B2 | * | 3/2012 | Fernandez et al. | 248/254 |
| 8,172,095 | B1 | * | 5/2012 | Herlihy | 211/70.6 |

* cited by examiner

ROTATING ORGANIZER USING JARS OR OTHER CONTAINERS FOR STORAGE

CROSS REFERENCE TO RELATED APPLICATION

This application is a Continuation-In-Part of Regular Utility patent application Ser. No. 12/564,916, filed Sep. 22, 2009, which is incorporated herein by reference.

BACKGROUND OF THE INVENTION

1. Field of the Invention

The present invention relates to organizers for holding items.

2. Description of the Prior Art

It is desirable for an organizer or storage device to be rotatable, to permit easier selection of desired items.

U.S. Pat. No. 1,732,131, issued on Oct. 15, 1929, to Benjamin S. Mahaffey, discloses a revolving display stand using jars for storage. The instant invention is distinguishable, in that in it the organizer has rotatable or cylindrical elongated attachment members.

U.S. Pat. No. 1,732,298, issued on Oct. 22, 1929, to Charles E. Arthur, discloses a revolving spice tray, with recesses in which the tops of items may be inserted. The instant invention is distinguishable, in that in it the lids of the jars are fastened to the slats, or other containers are removably retained on the slats.

U.S. Pat. No. 1,927,283, issued on Sep. 19, 1933, to Robert M. Hernandez, discloses a rotating display stand using jars or other containers for storage. The instant invention is distinguishable, in that in it the jars or other containers are retained on slats.

U.S. Pat. No. 2,436,289, issued on Feb. 17, 1948, to Thomas L.I. Carlson, discloses a rotating parts rack using jars for storage, having a pivot portion in the center of an axis of rotation. The instant invention is distinguishable, in that in it the axle is pivotally retained on its ends, or the end pieces are pivotally retained on the brackets.

U.S. Pat. No. 2,557,801, issued on Jun. 19, 1951, to Joseph Shapiro, discloses an under shelf attachment for containers, which, unlike the instant invention, does not rotate.

U.S. Pat. No. 2,936,901, issued on May 17, 1960, to George D. Siemantel, discloses a rotatable storage and display assembly for parts, which is suspended from a ceiling or other surface, but does not have rotatable or cylindrical elongated attachment members, as in the instant invention.

U.S. Pat. No. 2,944,761, issued on Jul. 12, 1960, to Bernard H. Best, discloses a rotary spool rack, which does not use jars, or Other containers, as in the instant invention.

U.S. Pat. No. 3,337,082, issued on Aug. 22, 1967, to Henri J. Dorgelys, discloses containers that can rotate, but does not disclose rotatable or cylindrical elongated attachment members, as in the instant invention.

U.S. Pat. No. 3,620,363, issued on Nov. 16, 1971, to William C. Donnithorne, discloses a rotating storage and display device, with tubes that are parallel to the axis of rotation. The instant invention is distinguishable, in that in it the jars can be unscrewed from lids attached to rotating slats, or other containers can be removed from the slats.

U.S. Pat. No. 3,674,155, issued on Jul. 4, 1972, to Lester A. Kessler, discloses a rotating tool storage device, with trays or holders suspended from the rotating part, but without lids attached to the rotating part, from which jars can be unscrewed, or containers that can be snapped out of apertures in routing slats, as in the instant invention.

U.S. Pat. No. 3,805,965, issued on Apr. 23, 1974, to Albert Champagne, discloses a storage unit having an upright post with several circular plates with lids attached to their undersides, from which jars can be unscrewed. The instant invention is distinguishable, in that it has rotating or cylindrical attachment members.

U.S. Pat. No. 4,601,628, issued on Jul. 22, 1986, to Michael M. Lowing, discloses rotary storage structures, which rotate on a horizontal axis, but without jars that can be screwed off from lids attached to slats, or containers that can be snapped out of apertures in slats, as in the instant invention.

U.S. Pat. No. 4,852,748, issued on Aug. 1, 1989, to William G. Burgess et al., discloses a ferris wheel shaped fixture holding apparatus, but does not disclose jars or other containers retained on slats, as in the instant invention.

U.S. Pat. No. 4,895,260, issued on Jan. 23, 1990, to Jane Ancona and Bruce Ancona, discloses a rack for cylindrical containers, in which the containers are retained in apertures, rather than their lids being fastened to slats, or other containers snapped into apertures in slats, as in the instant invention.

U.S. Pat. No. 5,069,361, issued on Dec. 3, 1991, to Robert W. Jeffway, Jr. and Catherine R. Dobosz, discloses a rotatable crayon caddy with a ratchet, but does not disclose the use of jars or other containers retained on slats for storage, as in the instant invention.

U.S. Pat. No. 5,083,670, issued on Jan. 28, 1992, to John J. Zimmer, discloses a revolving storage device for small items, with end caps of containers being affixed to a rotating drum, but it does not disclose rotatable or cylindrical elongated attachment members, as in the instant invention.

U.S. Pat. No. 5,228,582, issued on Jul. 20, 1993, to J. C. Marshall and James C. Marshall II, discloses a rotating holder for screws, bolts, nuts and washers, but does not disclose jars or other containers mounted on slats, as in the instant invention.

U.S. Pat. No. 5,248,049, issued on Sep. 28, 1993, to James E. Murphy, Sr., discloses a rotating tray caddy for holding items such as nuts and bolts, but without the jars or snap-in containers of the instant invention.

U.S. Pat. No. 6,029,828, issued on Feb. 29, 2000, to E. Stanley Robbins et al., discloses a turntable storage device, but does not disclose jar lids or containers mounted on multiple slats, as in the instant invention.

U.S. Pat. No. 6,056,132, issued on May 2, 2000, to Bryan Robert Becker and Sean M. Murray, discloses a magnetizable parts holder, including a revolving drum having externally-mounted magnets. The instant invention is distinguishable, in that it does not require the use of magnets, and has jar lids or containers attached to slats.

U.S. Pat. No. 6,234,326, issued on May 22, 2001, to Mark A. Higgins, James David Robertson and James Douglas Whiten, discloses a beverage display rack with head locking keyways, but does not disclose that it rotates as in the instant invention.

U.S. Pat. No. 7,207,448, issued on Apr. 24, 2007, to Frank Marino, Jr., discloses a modular storage system, with containers attached to the undersides of shelves, but it does not rotate as does the instant invention.

U.S. Pat. No. 7,275,647, issued on Oct. 2, 2007, to Alan S. Thompson, discloses a spice rack having a rotatable carriage with tracks within which containers are retained. The instant invention is distinguishable, in that in it the lids of the jars are fastened to slats, or other containers are retained on slats.

U.S. Pat. No. Des. 264,604, issued on May 25, 1982, to Howard Sussman, discloses a design for a desk unit for paper clips and sundries, without the jars or containers on slats of the instant invention.

U.S. Pat. No. Des. 278,585, issued on Apr. 30, 1985, to Rodnie D. Oldham, discloses a design for a rotatable storage rack for spice jars and the like, but not jars or containers that are attached to slats, as in the instant invention.

U.S. Pat. No. Des. 320,141, issued on Sep. 24, 1991, to Kenneth L. Farrell, discloses a design for a spice rack, but not an axle retained between pivots, or containers that snap into slats, as in the instant invention.

U.S. Pat. No. Des. 329,573, issued on Sep. 22, 1992, to Serge Picard, discloses a design for a container storage assembly, in which the lids of jars appear to be fastened to a member that may rotate, but it does not disclose that the lids or containers are retained on slats, as in the instant invention.

U.S. Pat. No. Des. 347,769, issued on Jun. 14, 1994, to Marcus W. Kibbe, discloses a design for a combined revolving spice rack and spice grinder containers, in which the lids of the containers appear to extend outward from the rack, rather than the lids or containers being fastened to slats, as in the instant invention.

U.S. Pat. No. Des. 369,710, issued on May 14, 1996, to Serge Picard and Dominique Lesquir, discloses a design for a revolving container storage assembly, but it does not disclose that the containers are retained on slats, as in the instant invention.

U.S. Pat. No. D488,643, issued on Apr. 20, 2004, to Gerald Birmingham, discloses a design for a portable storage unit, with shelves that may rotate, with the shelves having holes that may retain jars, but it does not disclose lids fastened to the rotating part, or containers that snap-in, as in the instant invention.

U.S. Pat. No. D542,583, issued on May 15, 2007, to Mark A. Watchowski and Loretta S. Watchowski, discloses a design for a hanging multi-storage device, but it does not disclose rotatable or cylindrical elongated attachment members, as in the instant invention.

French Patent No. 2 676 341, published on Nov. 20, 1992, to Michel Paris, discloses a wine cellar with rotary hydraulic elevated storage racks. It does not disclose jar lids or containers attached to rotating slats, as in the instant invention.

None of the above inventions and patents, taken either singly or in combination, is seen to describe the instant invention as claimed.

SUMMARY OF THE INVENTION

The present invention is an organizer that may be mounted on either a wall, wall to ceiling, ceiling, or many other ways, using limited space, and using jars or other containers for storage. Rotatable or cylindrical elongated attachment members allow it to be attached to different surfaces. It has slats (preferably eight wooden slats) that have jars attached. The slats may be fixed in place, or one or more of the slats may be rotatable. There are preferably six or seven jars, depending on the jar size, attached to each slats. The lids are fastened to the slats, and the jars can be opened by unscrewing them from their lids. There are handles on one end to rotate the storage system, and a ratchet on the interior to prevent slipping. The ratchet allows rotation in only one direction. Because they are transparent, the jars allow you to visually select what you are looking for. These jars can hold anything from hobby supplies to nuts and bolts. The fourth and fifth embodiments have containers With open tops, instead of jars. Potential applications range from garage organizing to commercial applications. It can be mounted in a commercial van for electricians or plumbers.

Accordingly, it is a principal object of the invention to provide an improved means for organizing various items by placing them in transparent containers.

It is another object of the invention to provide an improved means for finding a particular item from among the items organized.

It is a further object of the invention to provide an organizer for home use.

Still another object of the invention is to provide an organizer for business use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
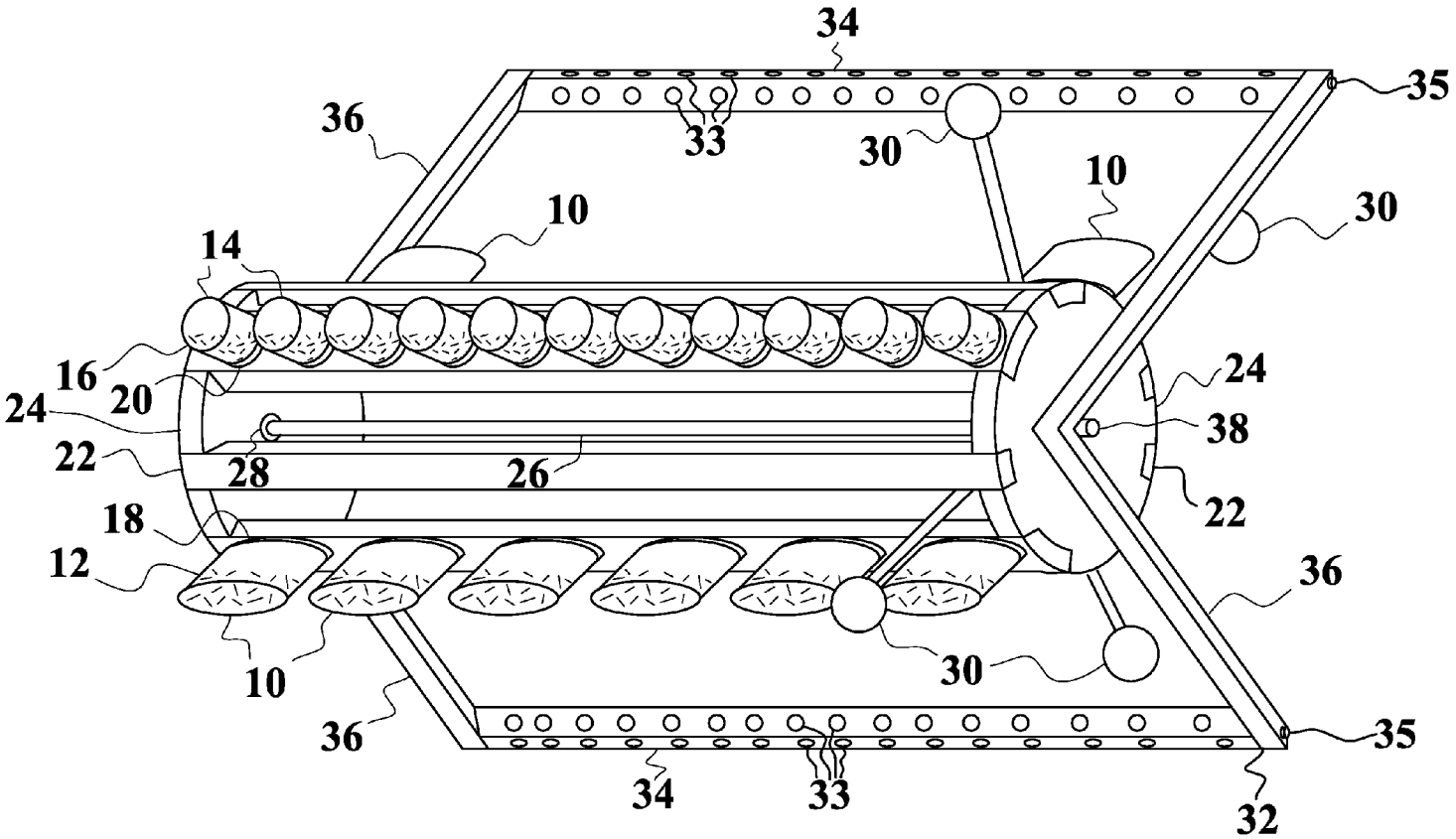
FIG. 1 is perspective view of the first preferred embodiment of the invention.

FIG. 1 is perspective view of the first preferred embodiment of the invention, showing large jars 10 containing items 12, and small jars 14 containing items 16. The jars are preferably made of transparent glass. Large jar lids 18 and small jar lids 20 are retained on rectangular slats 22 by screws, nails, glue or other suitable means. The jars are removably retained on the jar lids by external screw threads around the openings of the jars that engage internal screw threads in side walls of the jar lids. The slats are attached between two end members 24. The slats, end members, jar lids, jars and the items in them all rotate around the axle 26. The axle may either be a live axle that rotates with the slats, or it may be a dead axle that does not itself rotate. A ratchet 28 permits rotation in one direction only. Handles 30 that extend outward from the axle, and pass between the slats, permit manual rotation of the slats. Mounting bracket 32 has elongated surface attachment members 34, with apertures 33, are connected by pivots 35 to angled supporting members 36 to which axle supports 38 are welded. The two angled members are at opposite ends of the axle, with each of the angled members being perpendicular to the axle. The two surface attachment members are parallel to the axle, and can be attached to a surface. Each of the surface attachment members are attached to both of the angled members. The slats and end members are preferably made of wood, while the axle, supporting bracket and jar lids are preferably made of metal.

Figure 2:
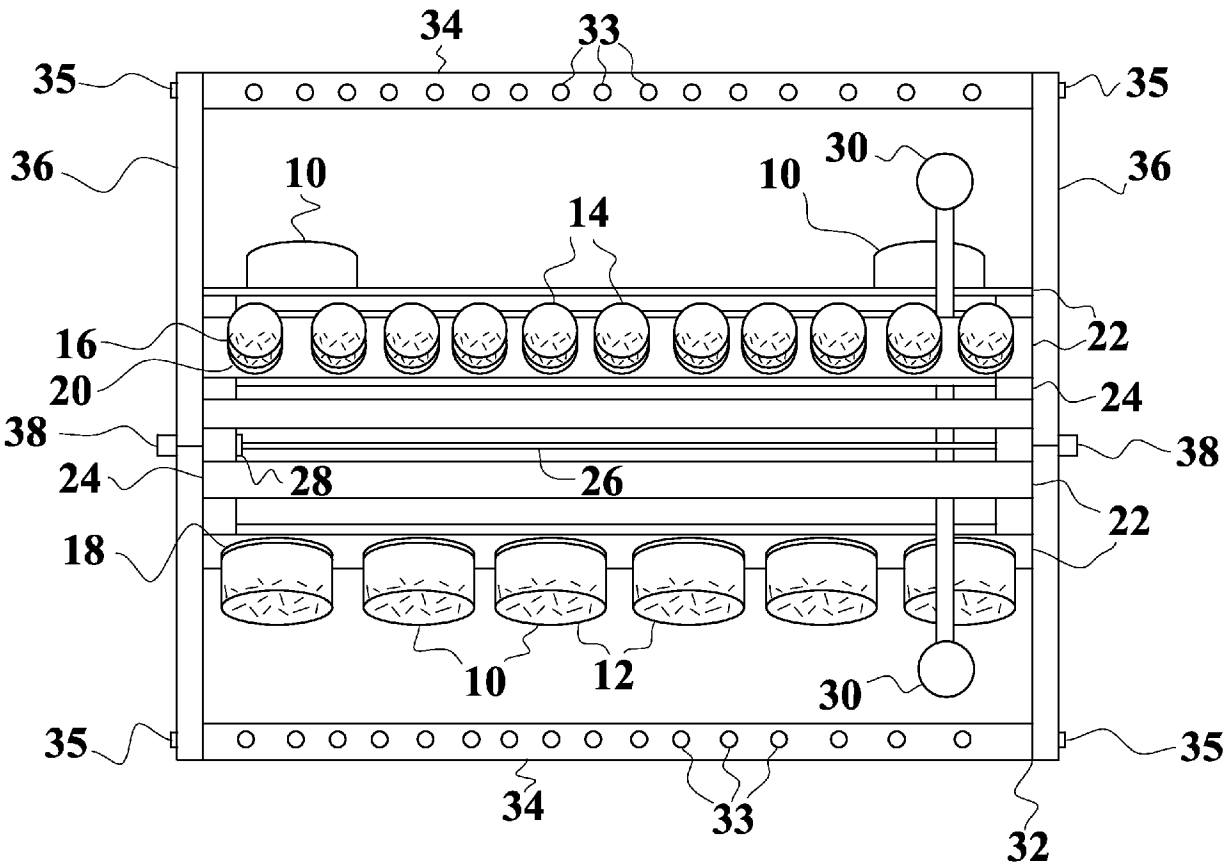
FIG. 2 is a front elevational view of the first preferred embodiment of the invention.

FIG. 2 is front elevational view of the first preferred embodiment of the invention, showing that opposite ends of the axle 26 are retained between the two axle supports 38, and that opposite ends of the elongated surface attachment members 34 are retained between ends of the angled supporting members 36 by pivots 35. Nails, screws, bolts or other fasteners can be inserted through the apertures 33 to retain the organizer to one or more surfaces. The elongated surface attachment members 34 can rotate 360 degrees on pivots 35, to enable the organizer to be fastened to a variety of surfaces having different angles.

Figure 3:
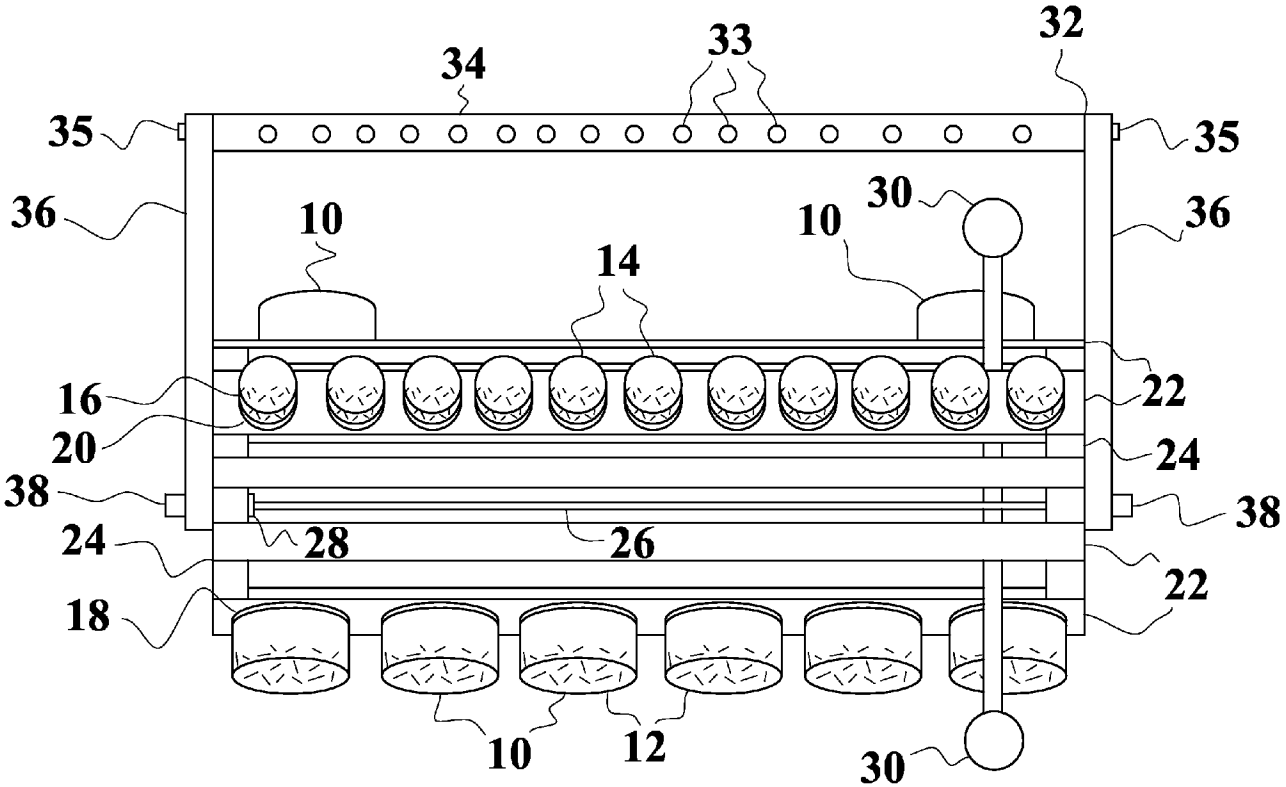
FIG. 3 is a top view of the first preferred embodiment of the invention.
Figure 4:
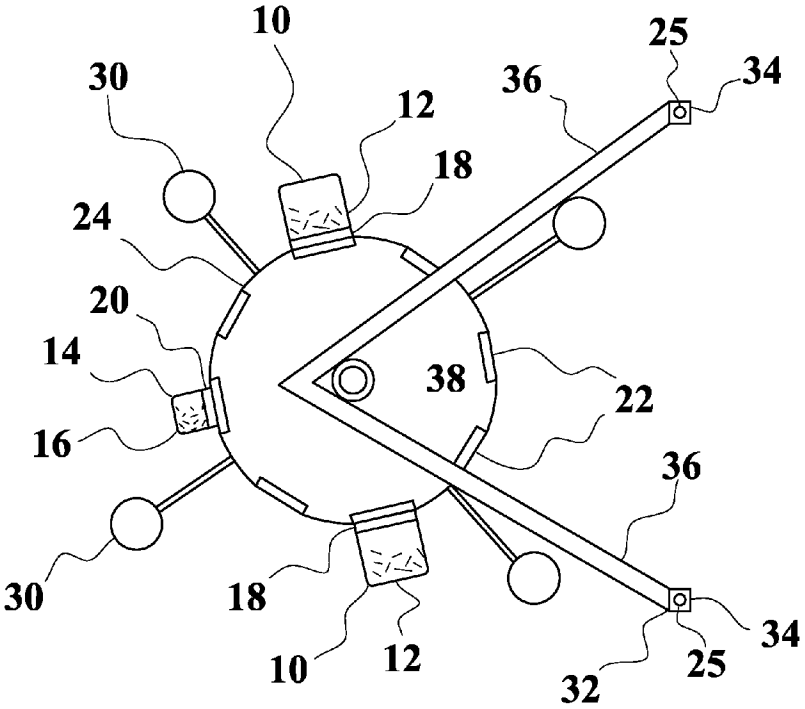
FIG. 4 is a right side view of the first preferred embodiment of the invention.

FIG. 3 is a top view of the first preferred embodiment of the invention. FIG. 4 is a right side view of the first preferred embodiment of the invention. The organizer is shown in these drawings as it will be seen when attached to a single vertical surface. The slats are parallel to the axle, and are entirely separated by spaces between the slats, without any contact between the slats. Each slat is an equal distance from the axle. Each slat is an equal distance from neighboring slats (i.e., the two slats that are closest to itself). The slats are radially symmetric with respect to the axle. The jar lids have flat circular tops that are attached to the slats, and cylindrical sides with internal screw threads that can engage external screw threads around openings of jars, and the cylindrical sides extend outward from the axle.

Figure 5:
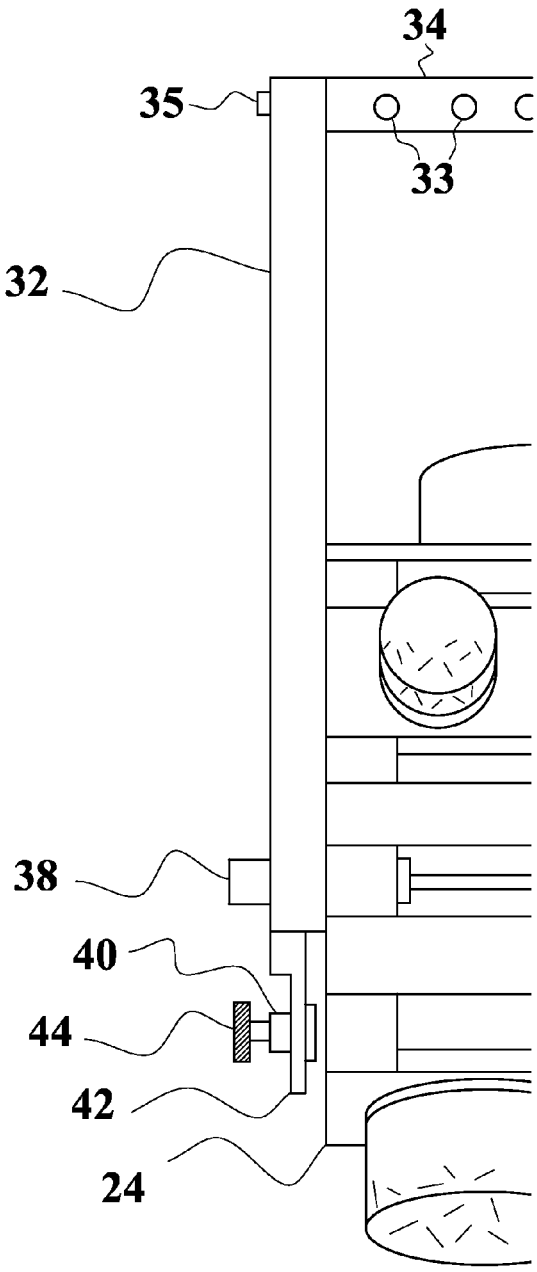
FIG. 5 is a detail view of the second preferred embodiment of the invention, showing the locking member in an open position.

FIG. 5 is a detail view of the second preferred embodiment of the invention, which is the same as the first preferred embodiment, except that it has a locking member 40, which is shown in an unlocked open position. The locking member is retained on an extension 42 from the supporting bracket 32. A knurled knob 44 can be manually rotated to move the locking member in and out.

Figure 6:
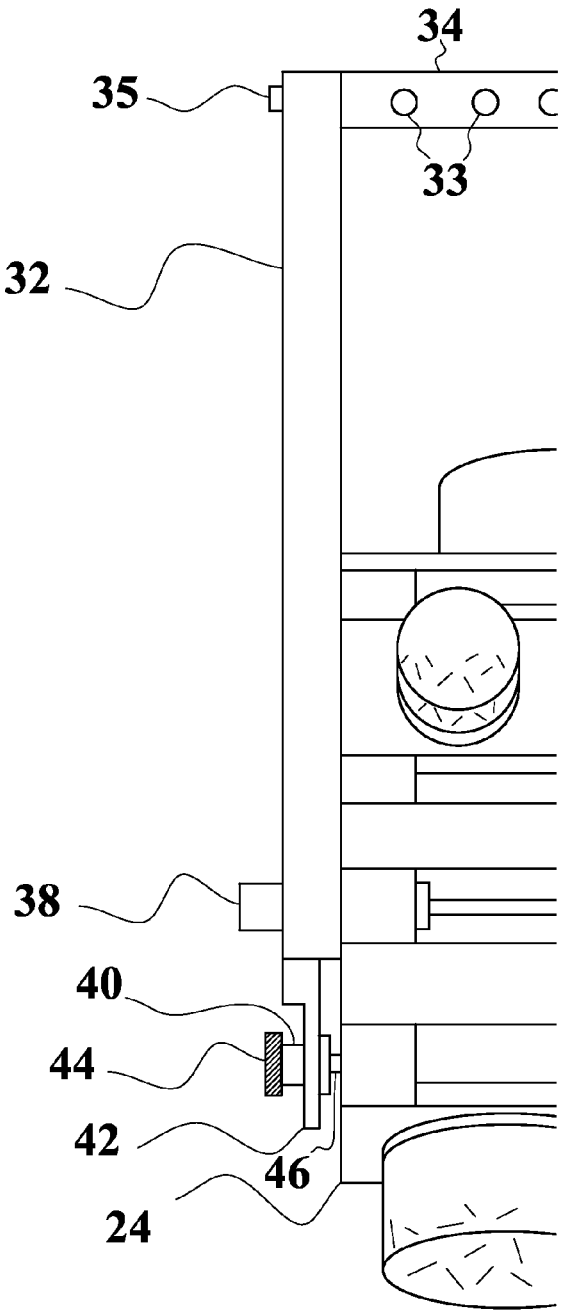
FIG. 6 is a detail view of the second preferred embodiment of the invention, showing the locking member in an closed position.

FIG. 6 is a detail view of the second preferred embodiment of the invention, showing the locking member in an locked closed position, in which the end 46 of the locking member engages end member 24, thus preventing the end member from rotating, and thereby also preventing the slats and jars from rotating.

Figure 7:
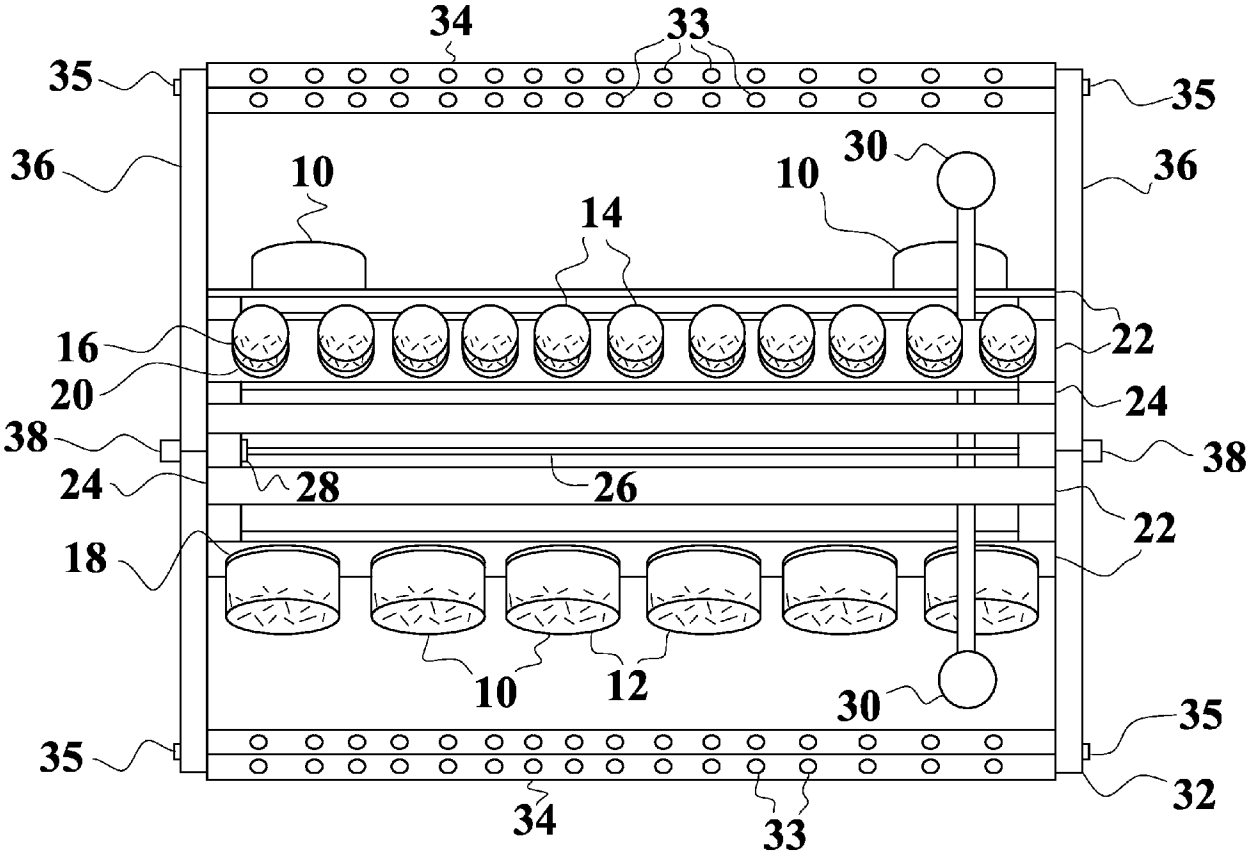
FIG. 7 is a front elevational view of the first preferred embodiment of the invention, showing the elongated attachment members rotated 45 degrees from their positions shown in FIG. 2.

FIG. 7 is a front elevational view of the first preferred embodiment of the invention, showing the elongated attachment member rotated 45 degrees from its position shown in FIG. 2.

Figure 8:
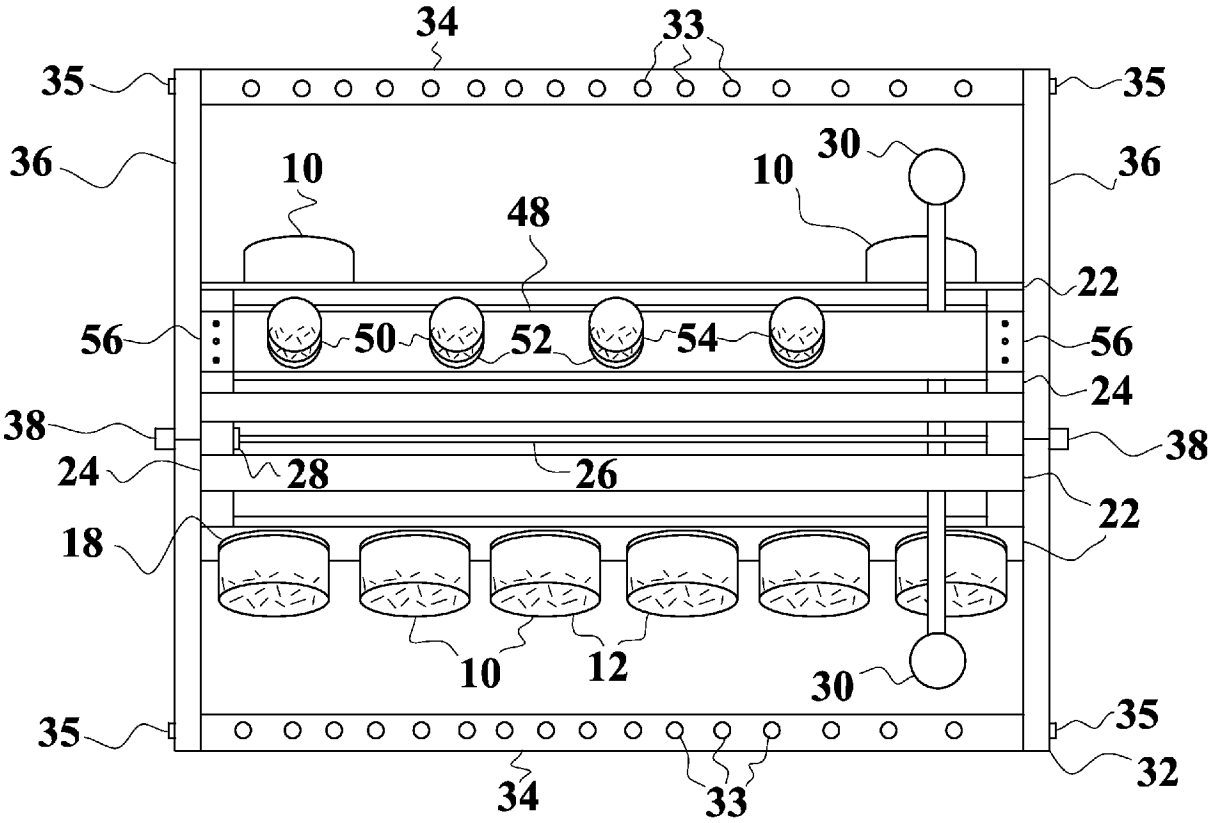
FIG. 8 is a front elevational view of the third preferred embodiment of the invention, showing the rotatable slat in a first position.
Figure 9:
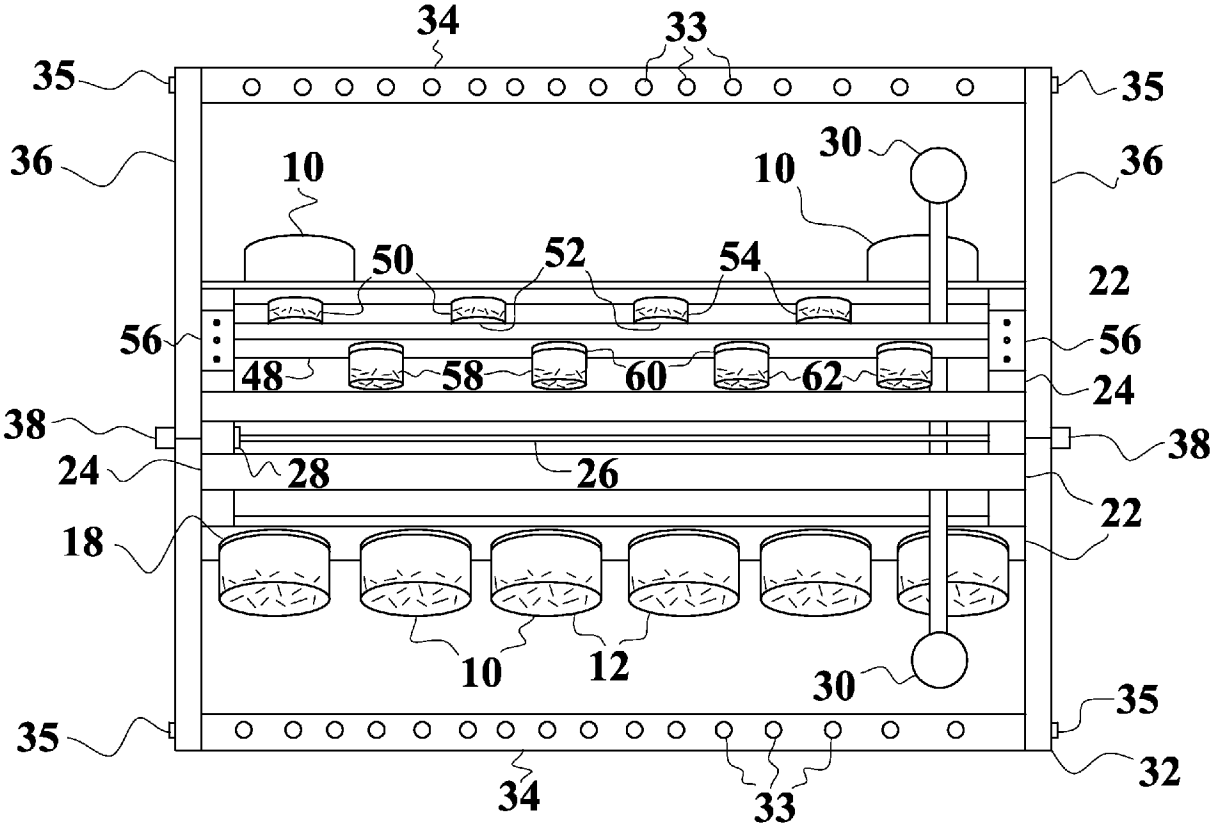
FIG. 9 is a front elevational view of the third preferred embodiment of the invention, showing the rotatable slat in a second position.
Figure 10:
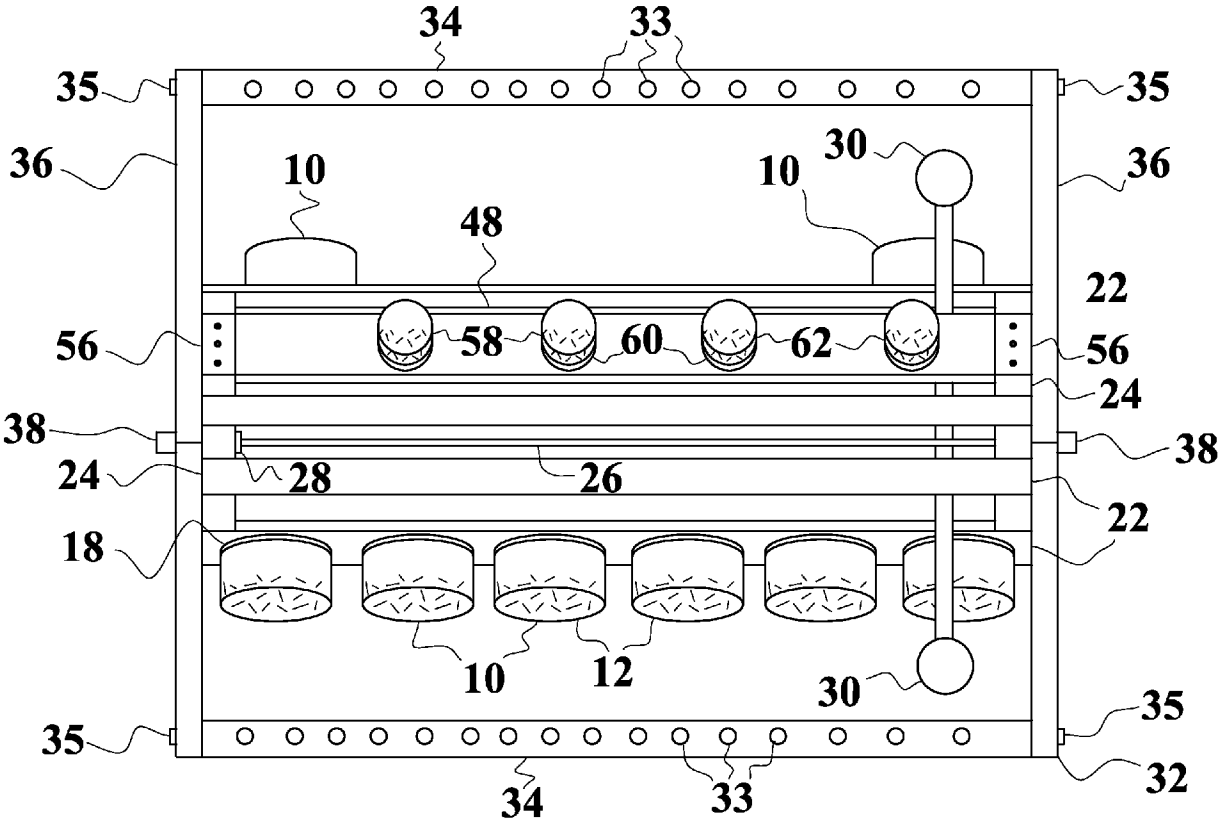
FIG. 10 is a front elevational view of the third preferred embodiment of the invention, showing the rotatable slat in a third position.

The slats may be fixed in place with respect to the end member, or one or more slats may be pivotally connected to the end members so that they can rotate three hundred sixty degrees on their longitudinal centers. FIG. 8 is a front elevational view of the third preferred embodiment of the invention, which is the same as the first preferred embodiment of the invention, except that it has one rotatable slat, showing the rotatable slat 48 in a first position, with a first set of rotatable jars 50 facing forward, having lids 52 attached to a first side of the rotatable slat, and containing items 54. The rotatable slat is connected to the end members 24 by pivotal attachment members 56. FIG. 9 is a front elevational view of the third preferred embodiment of the invention, showing the rotatable slat in a second position, in which it has been rotated ninety degrees from the first position, showing both the first set of rotatable jars and a second set of rotatable jars 58 attached to an opposite second side of the rotatable slat. FIG. 10 is a front elevational view of the third preferred embodiment of the invention, showing the rotatable slat in a third position, in which it has been rotated one hundred eighty degrees from the first position, with the second set of rotatable jars facing forward, having lids 60 attached to the second side of the rotatable slat, and containing items 62.

Figure 11:
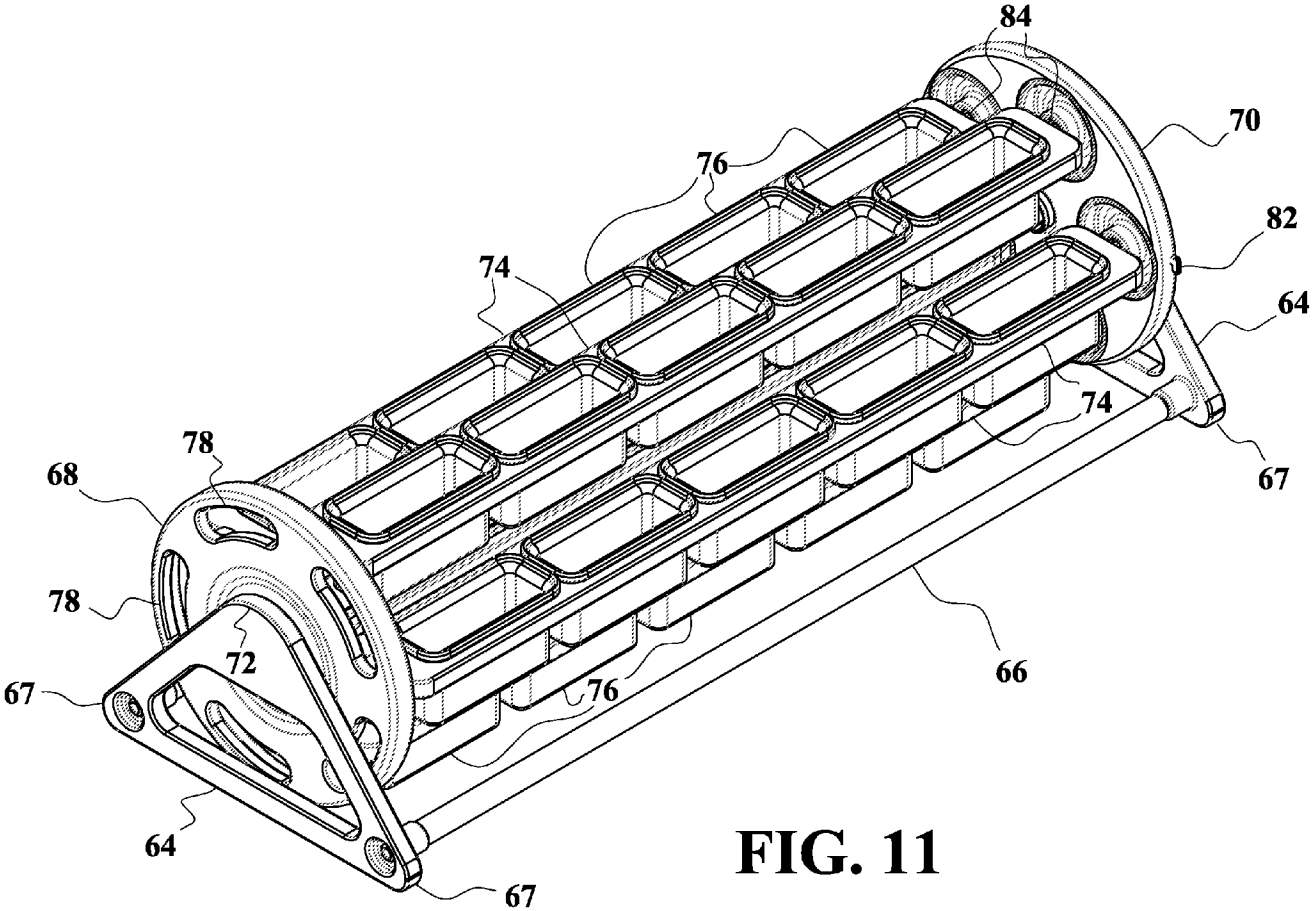
FIG. 11 is a perspective view of the fourth preferred embodiment of the invention, with the left end facing forward.

FIG. 11 is a perspective view of the fourth preferred embodiment of the invention, with the left end facing forward. The fourth preferred embodiment includes two triangular end brackets 64, between which are two cylindrical attachment members 66 connected near lower vertices 67 of the triangular end brackets. A left rotating circular end piece 68 and a right rotating circular end piece 70 are pivotally connected near upper vertices 72 of the triangular end brackets. Several slats 74 are each pivotally connected at their ends to each of the two end pieces. In each slat, open-topped containers 76 are removably retained in apertures (not shown in the drawings) in the slats. The containers may be snapped into and out of the apertures in the slats. The left end piece has openings 78 that can be used as handles to rotate the end pieces, slats and containers.

Figure 12:
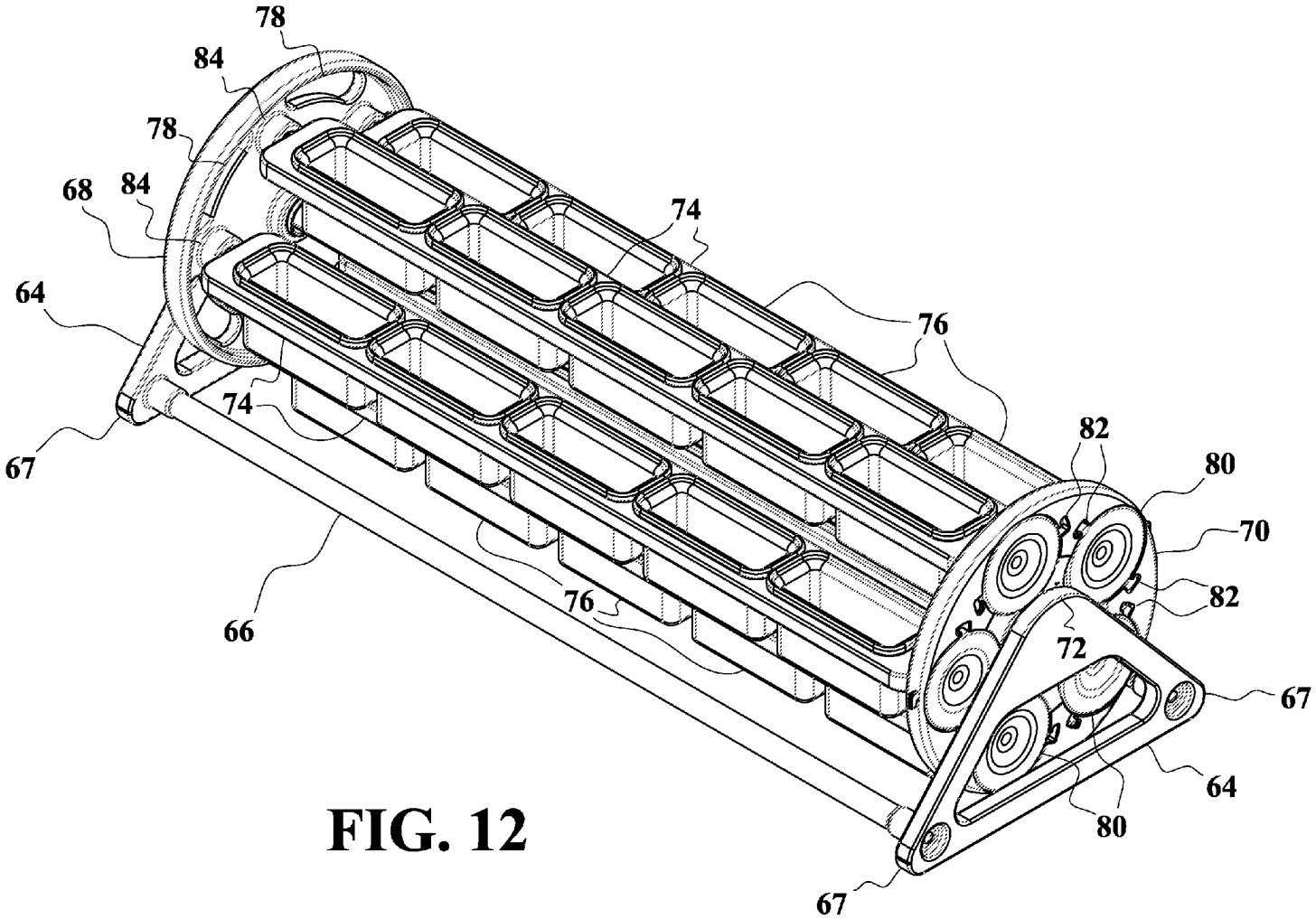
FIG. 12 is a perspective view of the fourth preferred embodiment of the invention, with the right end facing forward.

FIG. 12 is a perspective view of the fourth preferred embodiment of the invention, with the right end facing forward. The right end piece has circular handles 80 with grips 82 by which each slat may be individually rotated by hand. In the absence of such manipulation, the slats and their containers are self-leveling, i.e., gravity will cause the slats and their containers to rotate on the slats' pivotal connections to the end pieces, so that the open tops of the containers remain upward.

Figure 13:
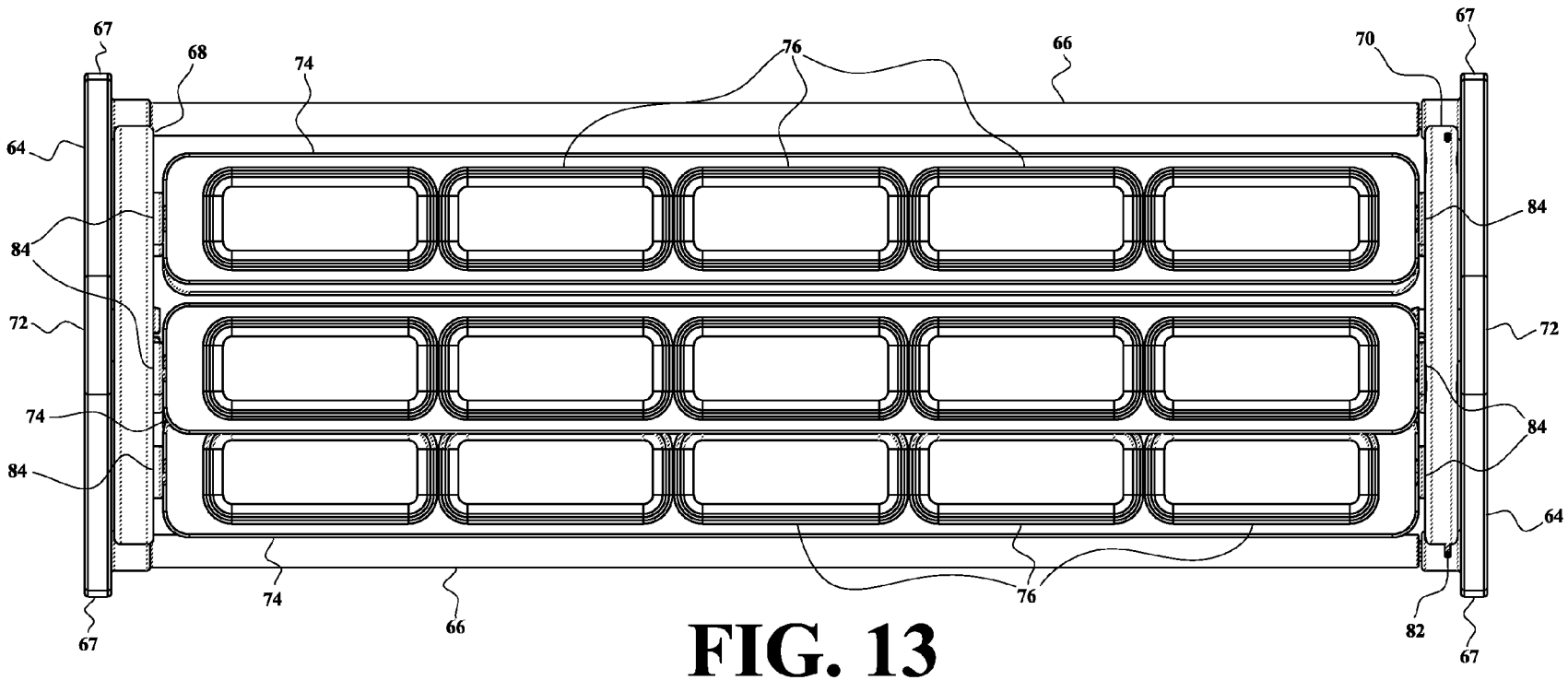
FIG. 13 is a top view of the fourth preferred embodiment of the invention.
Figure 14:
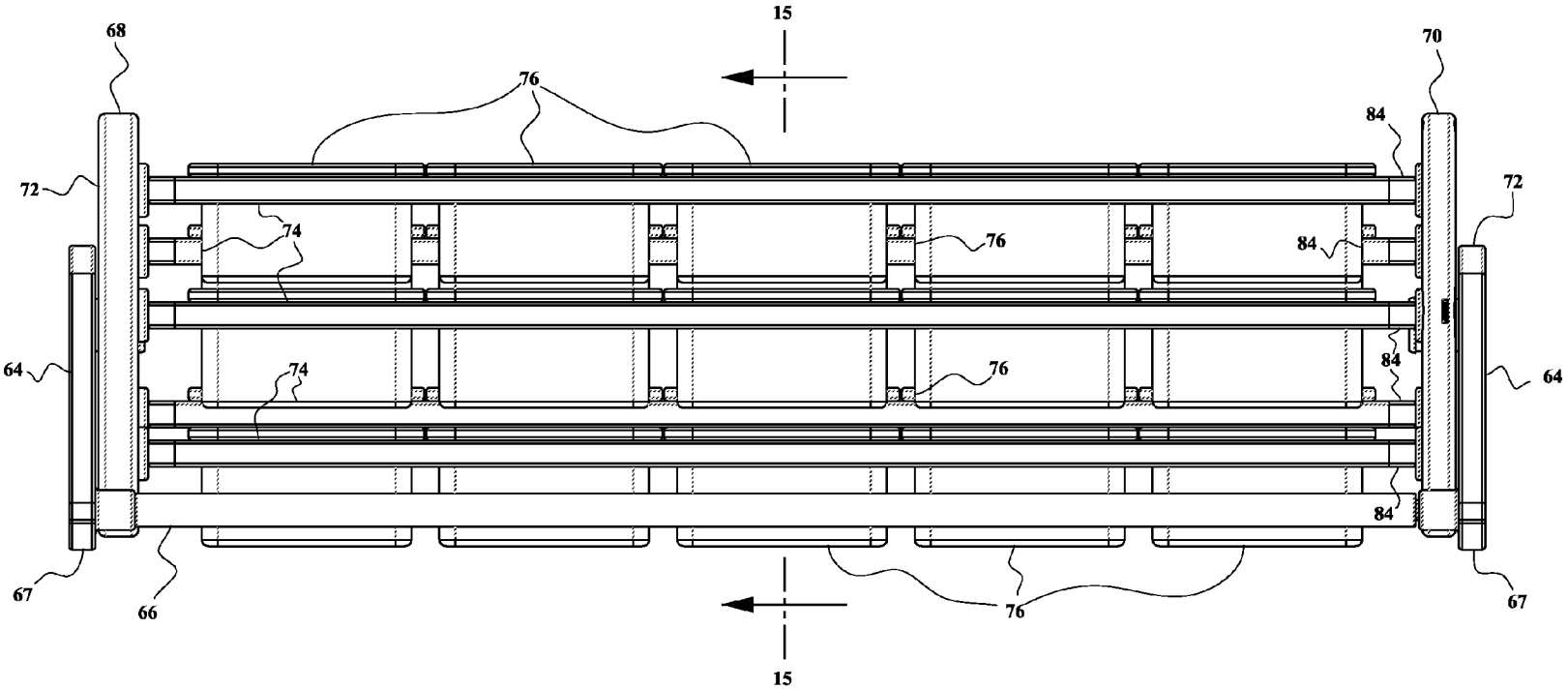
FIG. 14 is a front elevational view of the fourth preferred embodiment of the invention.
Figure 15:
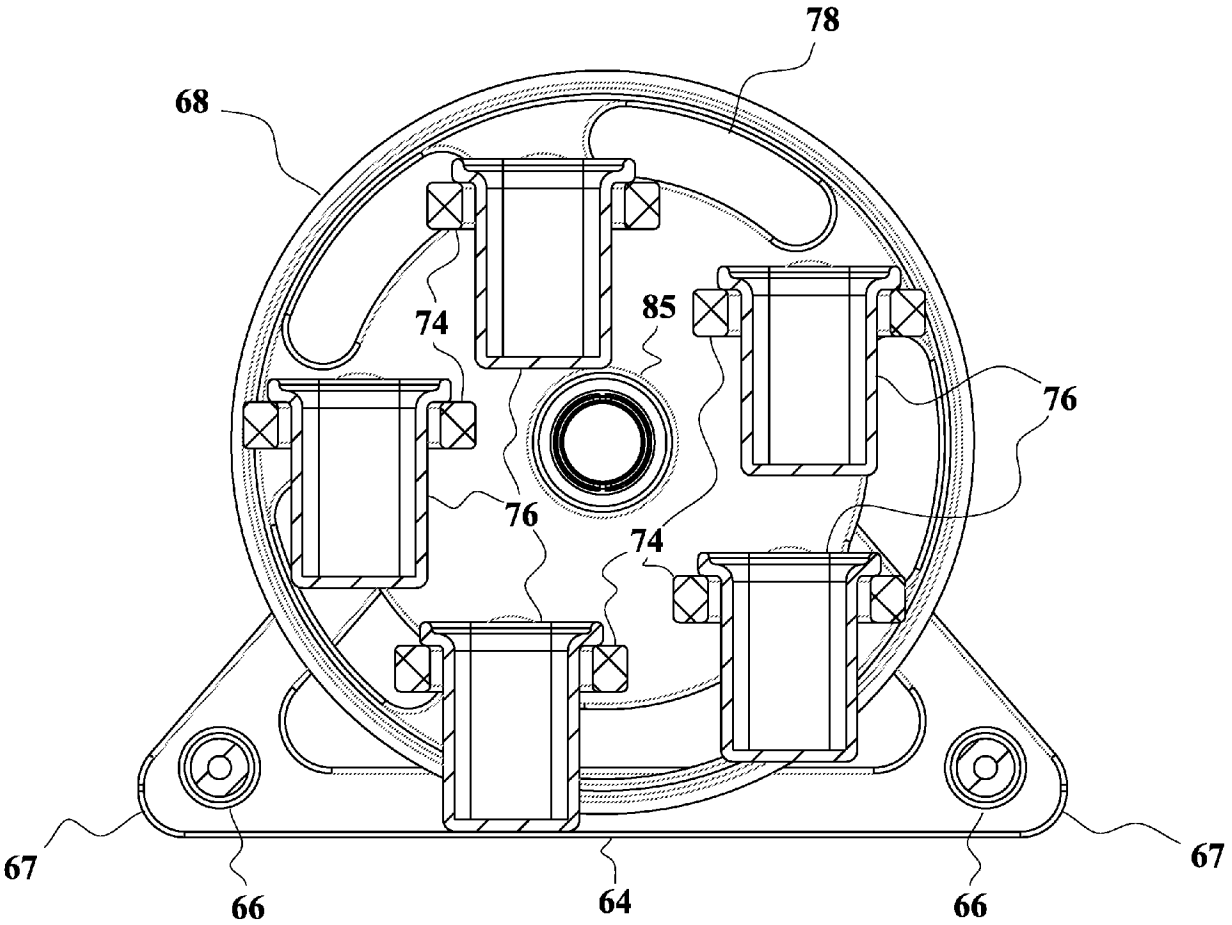
FIG. 15 is a sectional view of the fourth preferred embodiment of the invention, along lines 15-15 in FIG. 14.
Figure 16:
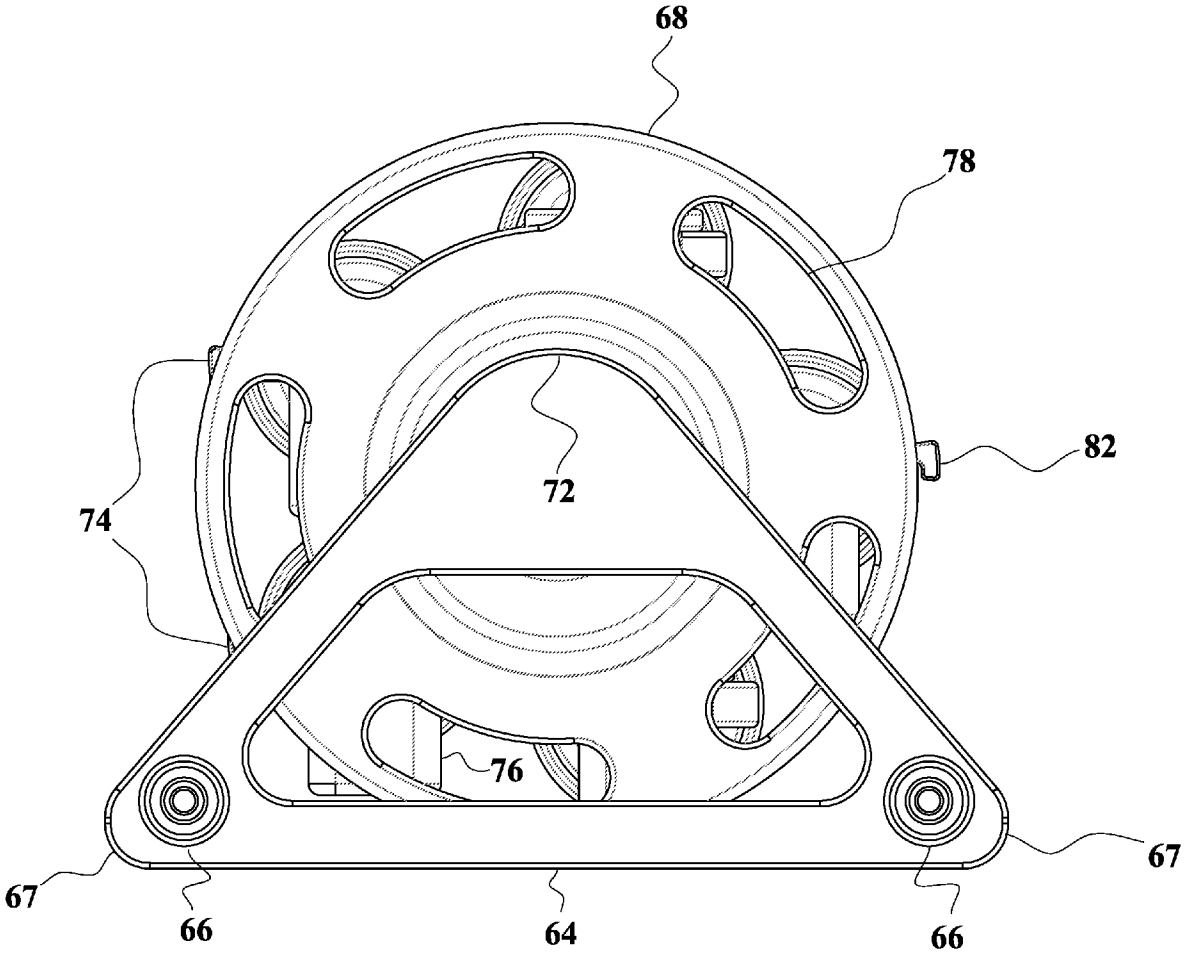
FIG. 16 is a left side elevational view of the fourth preferred embodiment of the invention.
Figure 17:
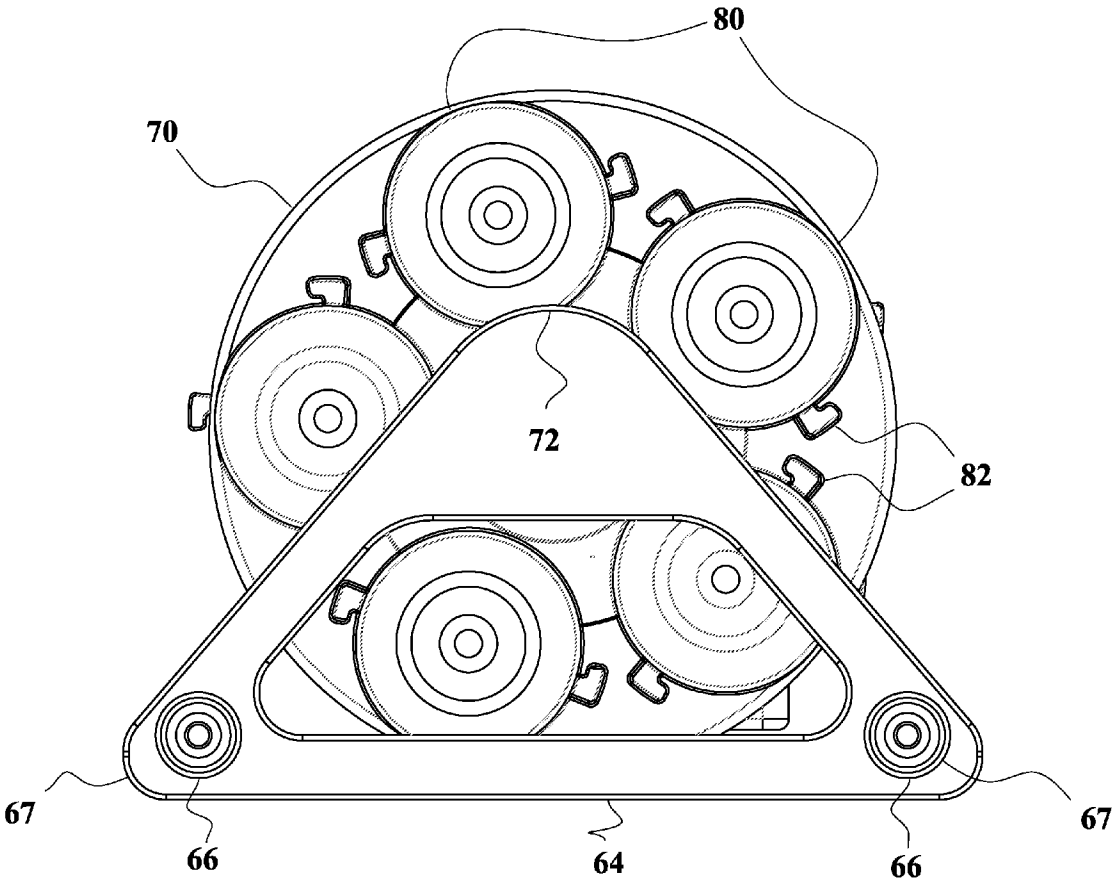
FIG. 17 is a right side elevational view of the fourth preferred embodiment of the invention.
Figure 18:
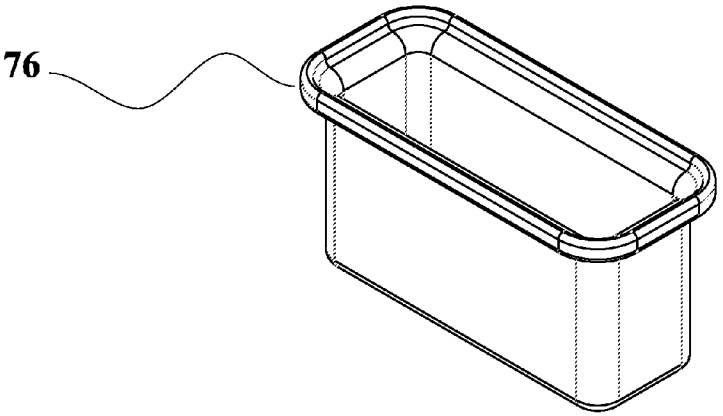
FIG. 18 is a perspective detail view of a removable container of the fourth preferred embodiment of the invention.
Figure 19:
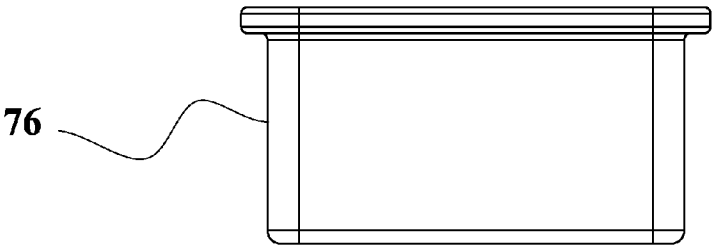
FIG. 19 is a front elevational detail view of a removable container of the fourth preferred embodiment of the invention.
Figure 20:
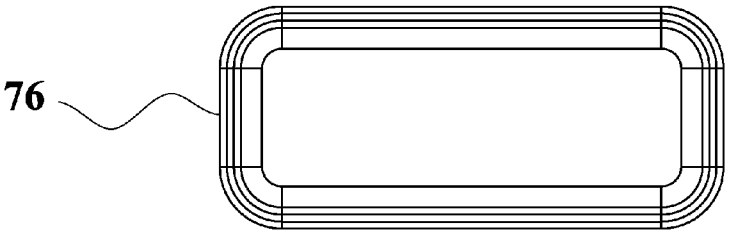
FIG. 20 is a top detail view of a removable container of the fourth preferred embodiment of the invention.
Figure 21:
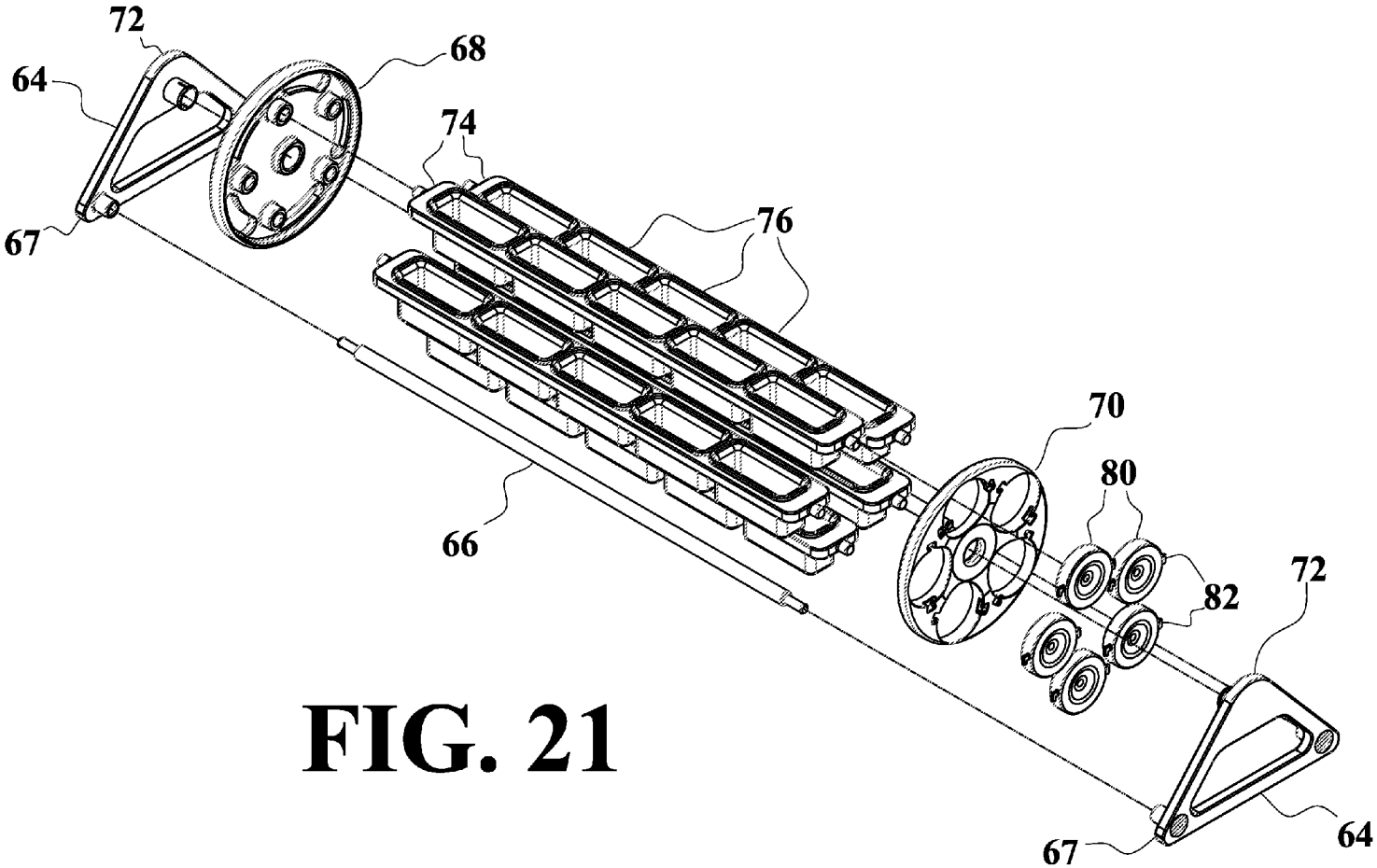
FIG. 21 is an exploded perspective view of the fourth preferred embodiment of the invention, with the right end facing forward.
Figure 22:
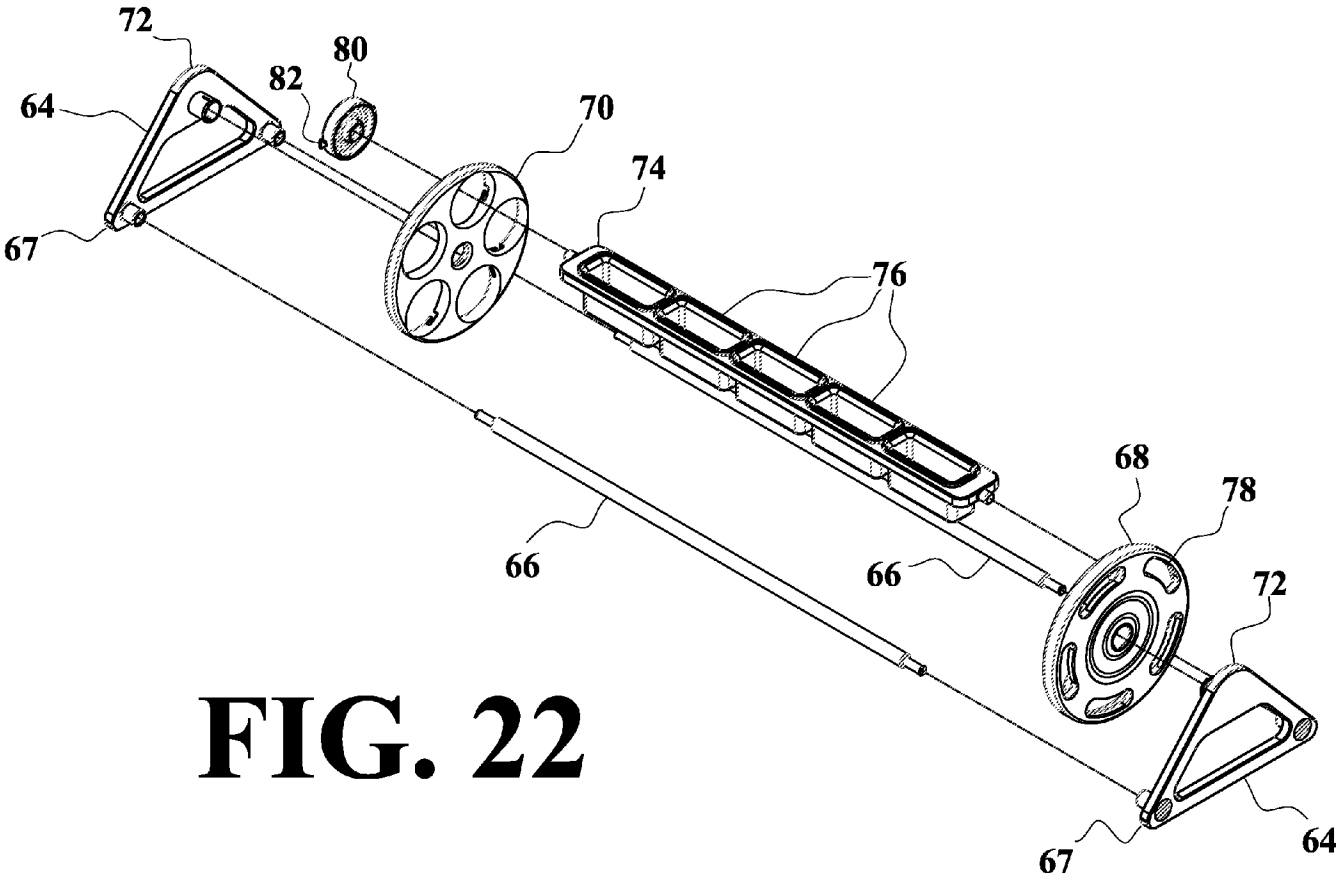
FIG. 22 is an exploded perspective view of the fourth preferred embodiment of the invention, with the left end facing forward.

FIG. 13 is a top view of the fourth preferred embodiment of the invention, showing the pivots 84 by which the slats are connected to the circular end pieces. FIG. 14 is a front elevational view of the fourth preferred embodiment of the invention. FIG. 15 is a sectional view of the fourth preferred embodiment of the invention, along lines 15-15 in FIG. 14, showing the pivotal connection 85 of the left end of the piece 68 to the end bracket 64. FIG. 16 is a left side elevational view of the fourth preferred embodiment of the invention. FIG. 17 is a right side elevational view of the fourth preferred embodiment of the invention. FIG. 18 is a perspective detailed view of a removable container of the fourth preferred embodiment of the invention. FIG. 19 is a front elevational detail view of a removable container of the fourth preferred embodiment of the invention. FIG. 20 is a top detail view of a removable container of the fourth preferred embodiment of the invention. FIG. 21 is an exploded perspective view of the fourth preferred embodiment of the invention, with the right end facing forward. FIG. 22 is an exploded perspective view of the fourth preferred embodiment of the invention, with the left end facing forward.

FIG. 14 is a front elevational view of the fourth preferred embodiment of the invention.

FIG. 15 is a sectional view of the fourth preferred embodiment of the invention, along lines 15-15 in FIG. 14.

FIG. 16 is a left side elevational view of the fourth preferred embodiment of the invention.

FIG. 17 is a right side elevational view of the fourth preferred embodiment of the invention.

FIG. 18 is a perspective detail view of a removable container of the fourth preferred embodiment of the invention.

FIG. 19 is a front elevational detail view of a removable container of the fourth preferred embodiment of the invention.

FIG. 20 is a top detail view of a removable container of the fourth preferred embodiment of the invention.

FIG. 21 is an exploded perspective view of the fourth preferred embodiment of the invention, with the right end facing forward.

FIG. 22 is an exploded perspective view of the fourth preferred embodiment of the invention, with the left end facing forward.

Figure 23:
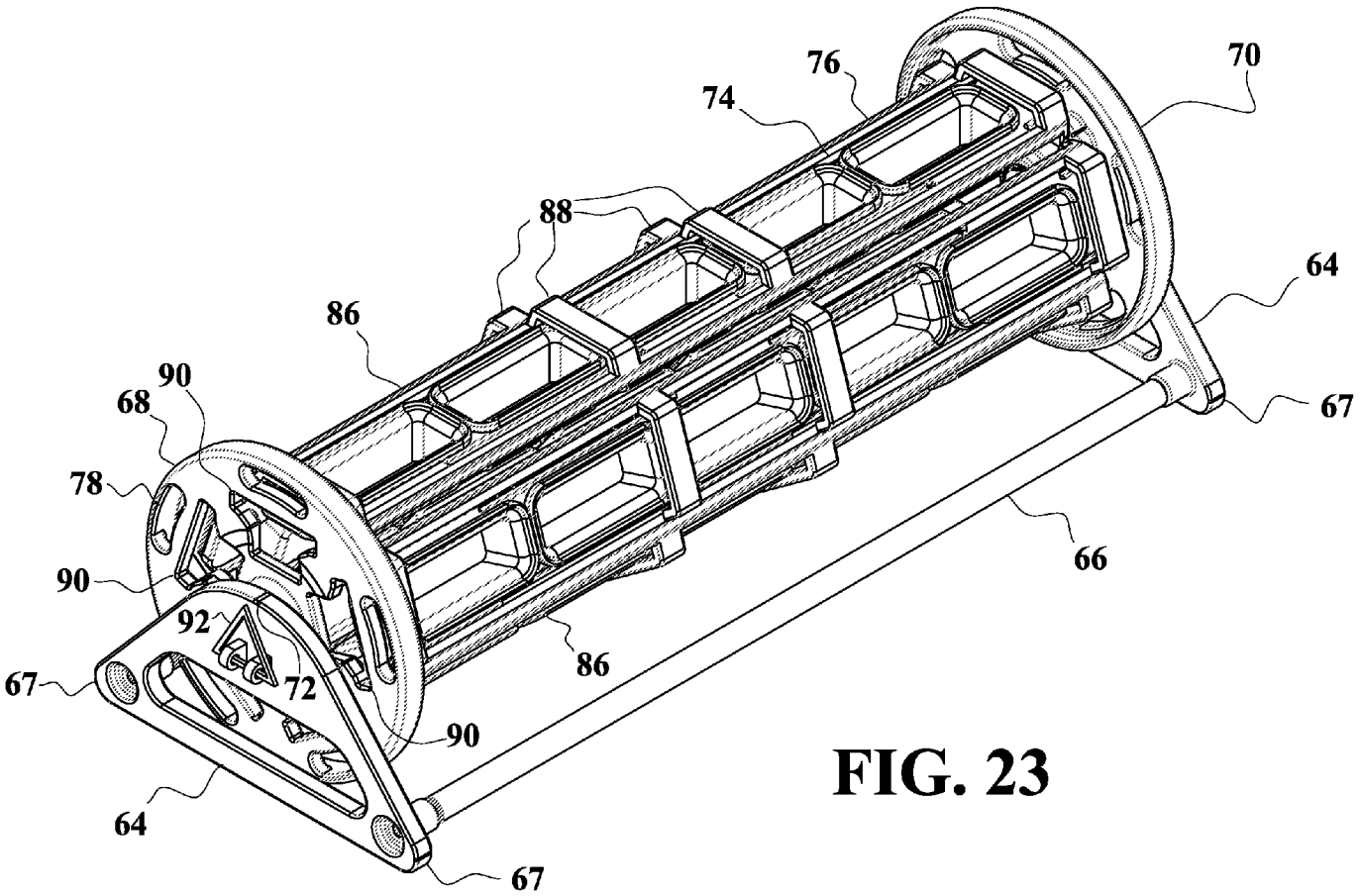
FIG. 23 is a perspective view of the fifth preferred embodiment of the invention, with the left end facing forward.

FIG. 23 is a perspective view of the fifth preferred embodiment of the invention, with the left end facing forward. The fifth preferred embodiment is similar to the fourth preferred embodiment, with the following differences: The slats are retained in a fixed position between the end pieces. The slats have covers 86 that can prevent items from falling out of the containers. The covers have handles 88. The slats and the covers can be slid out through passages 90 in the left end piece. The covers can be slid out while the slats remain between the end pieces, or both slats and the covers can be slid out while the covers remain on the slats, and covers can then be removed from the slats later. There are handles 92 near the upper vertex of each triangular end bracket.

Figure 24:
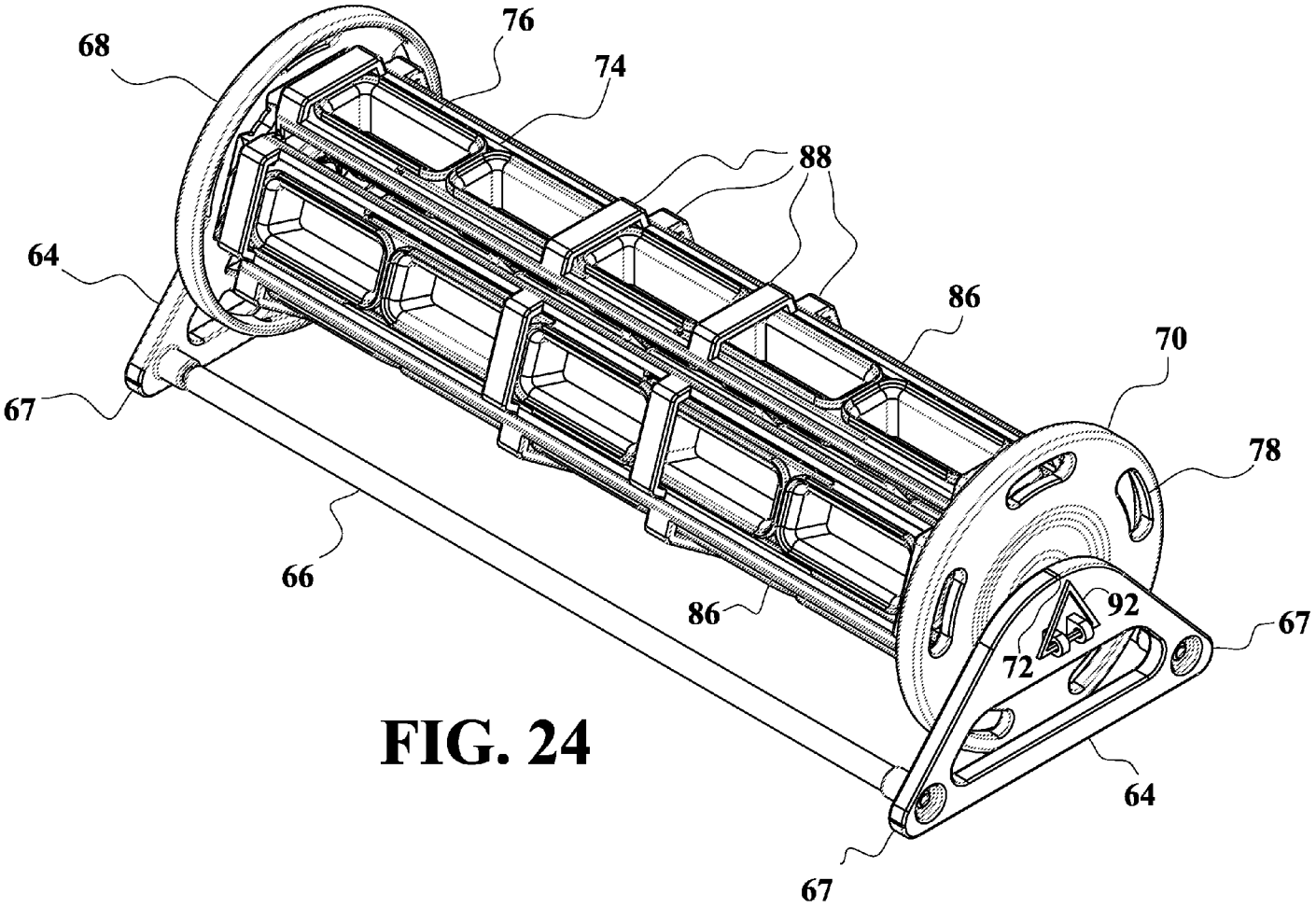
FIG. 24 is a perspective view of the fifth preferred embodiment of the invention, with the right end facing forward.
Figure 25:
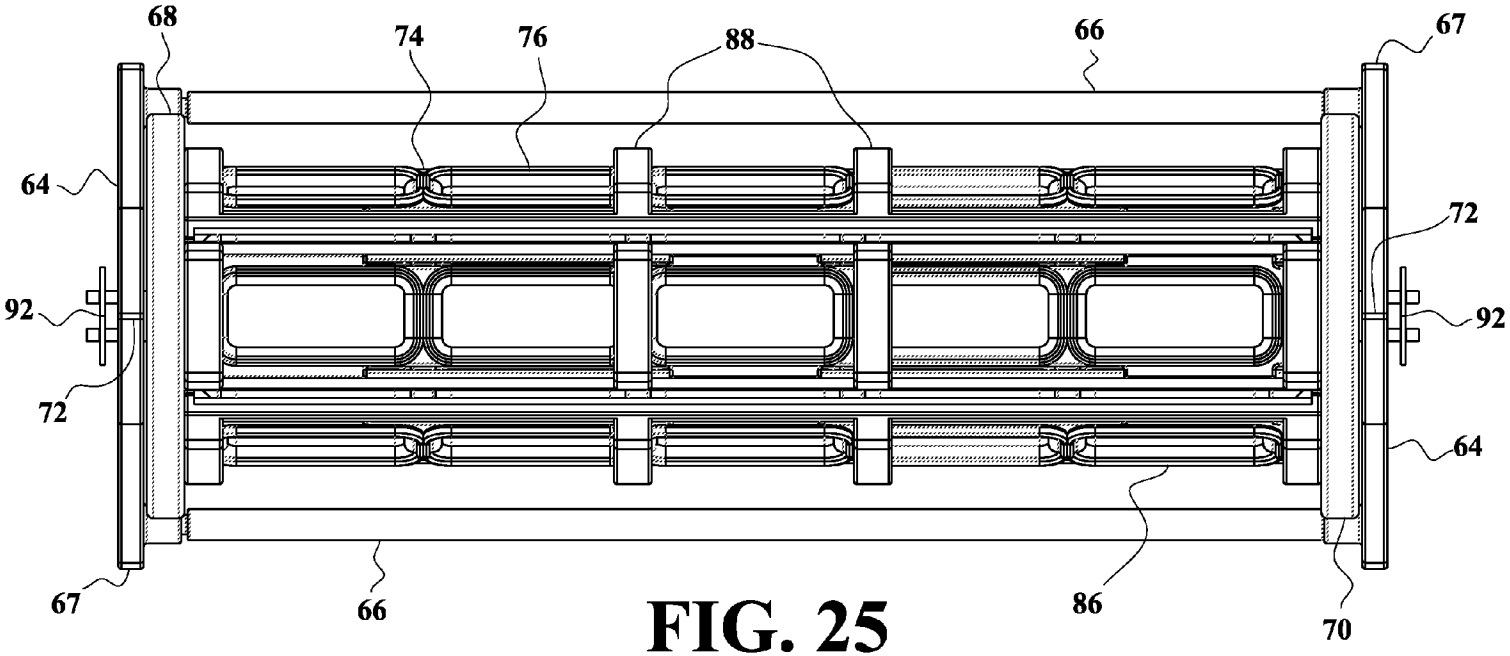
FIG. 25 is a top view of the fifth preferred embodiment of the invention.
Figure 26:
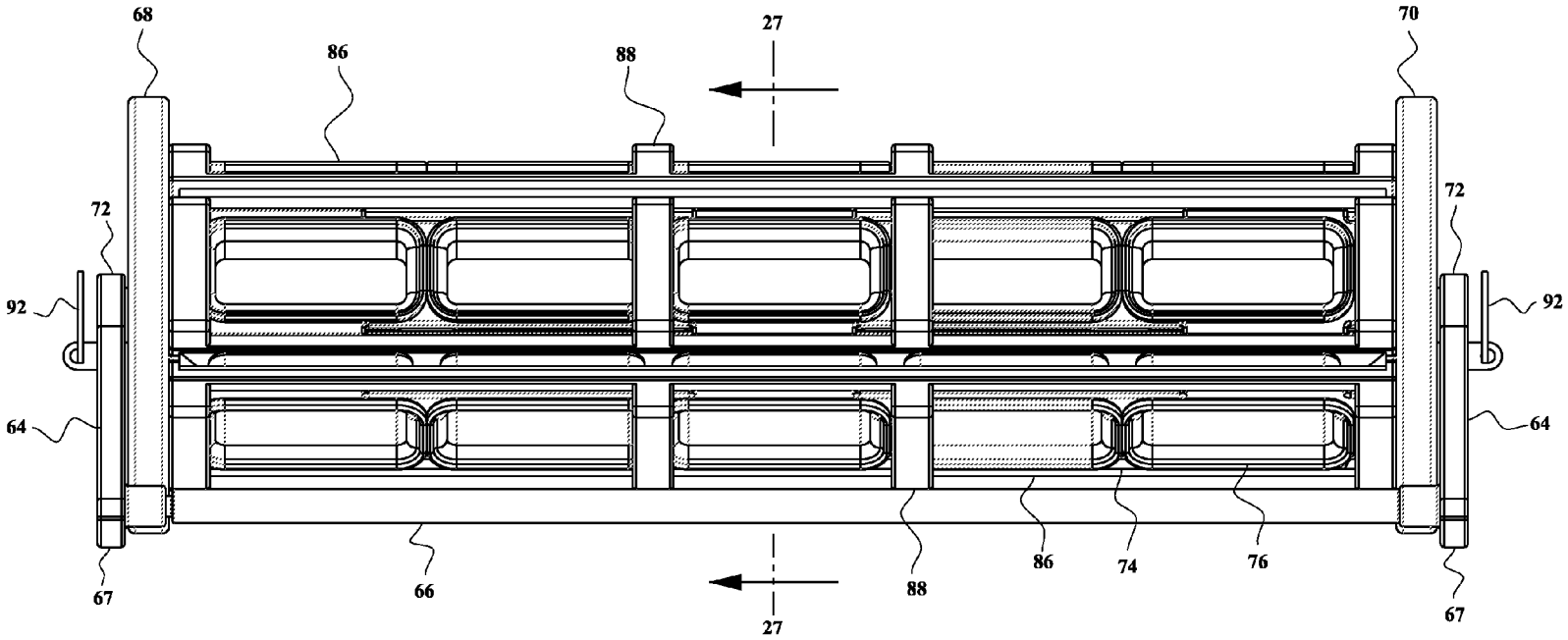
FIG. 26 is a front elevational view of the fifth preferred embodiment of the invention.
Figure 27:
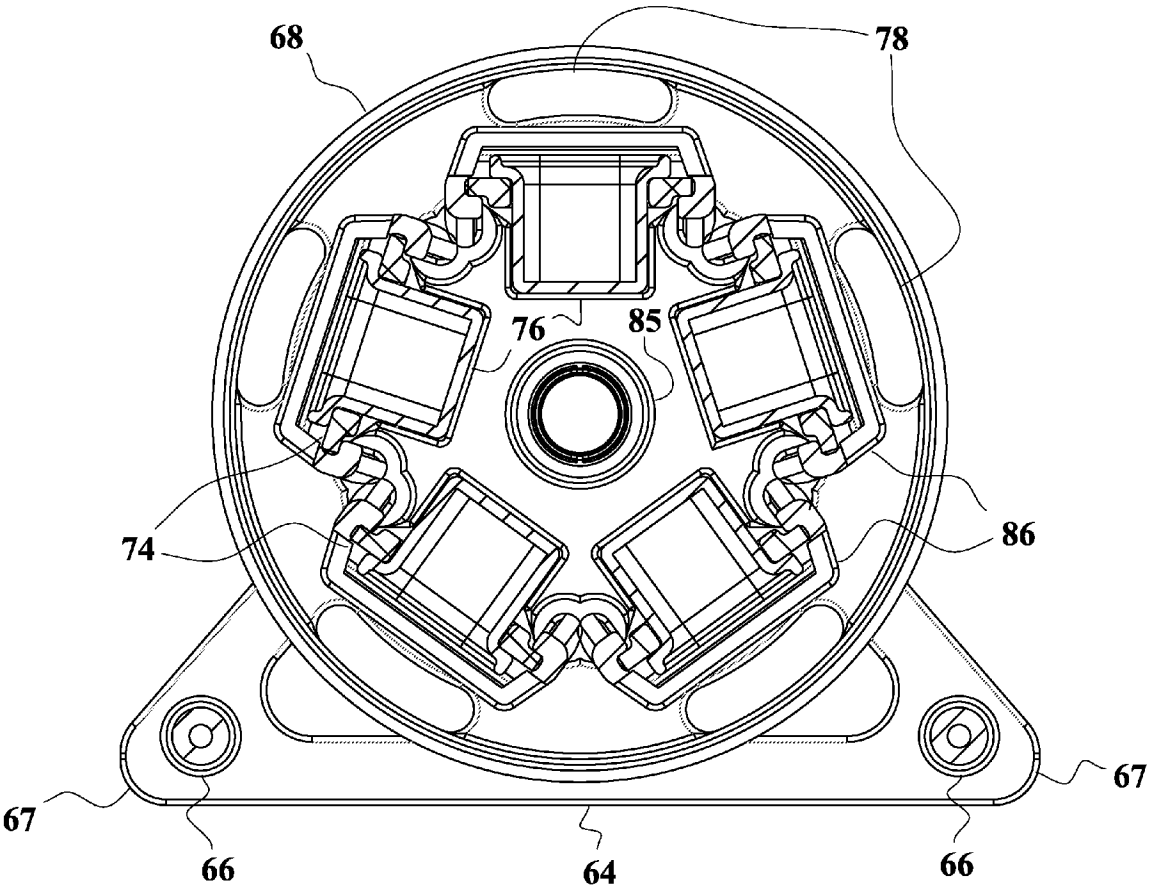
FIG. 27 is a sectional view of the fifth preferred embodiment of the invention, along lines 27-27 in FIG. 26.
Figure 28:
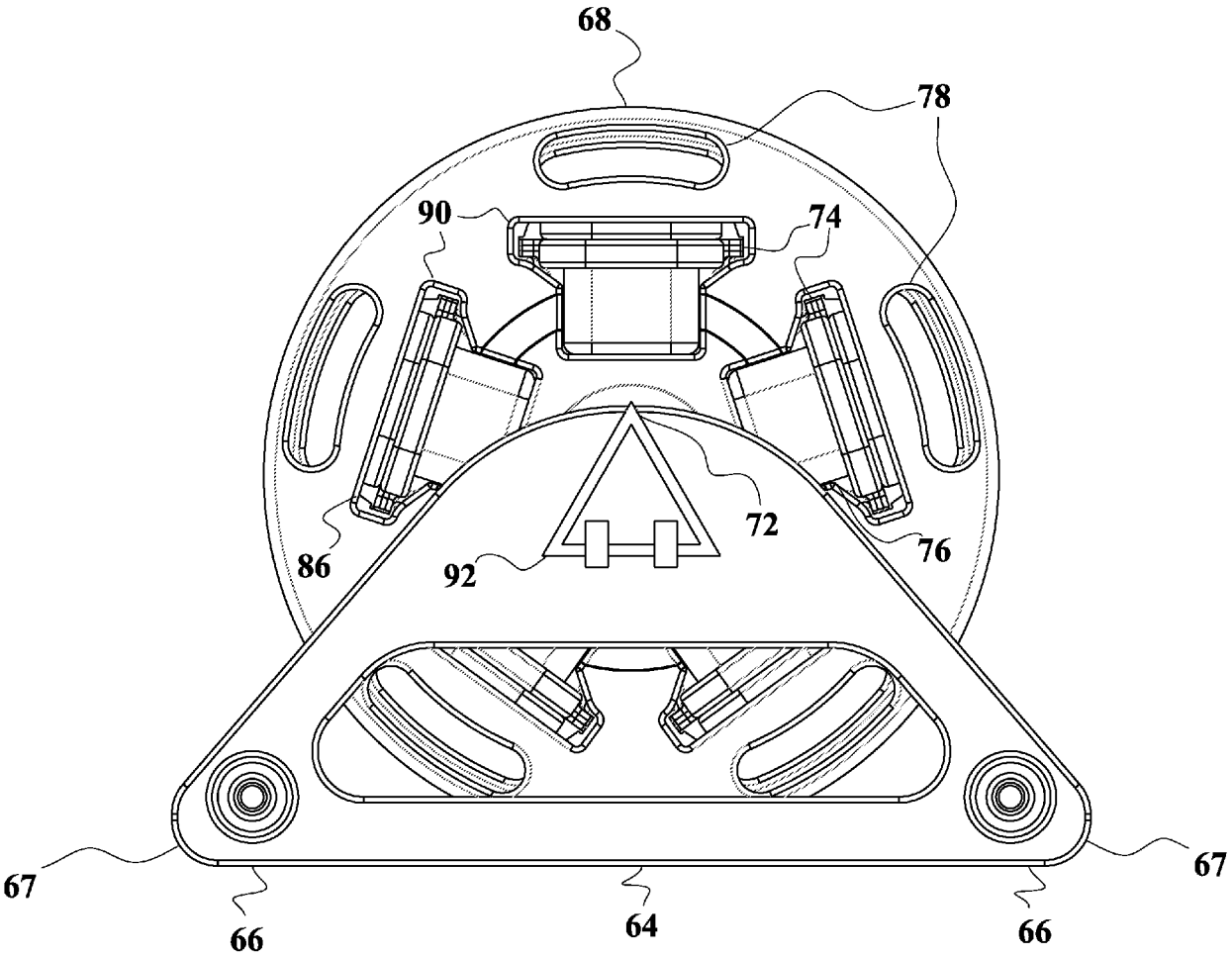
FIG. 28 is a left side elevational view of the fifth preferred embodiment of the invention.
Figure 29:
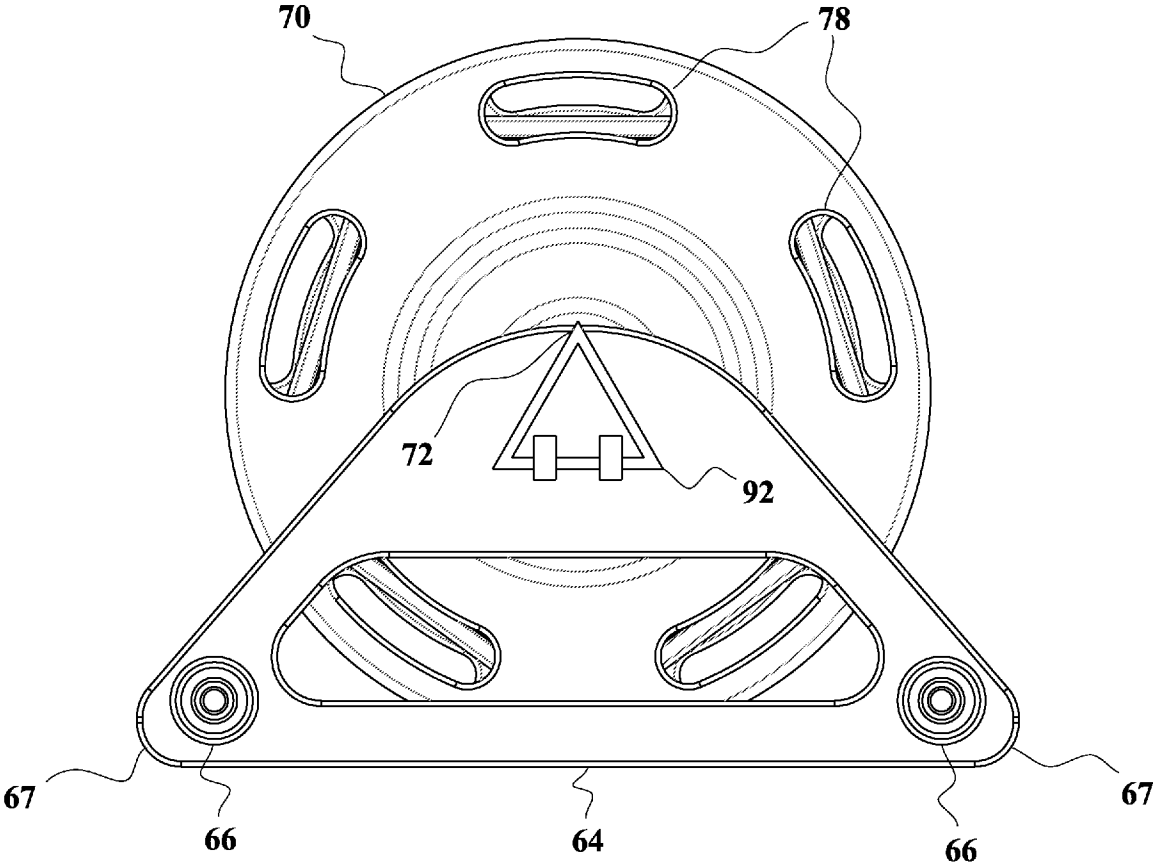
FIG. 29 is a right side elevational view of the fifth preferred embodiment of the invention.
Figure 30:
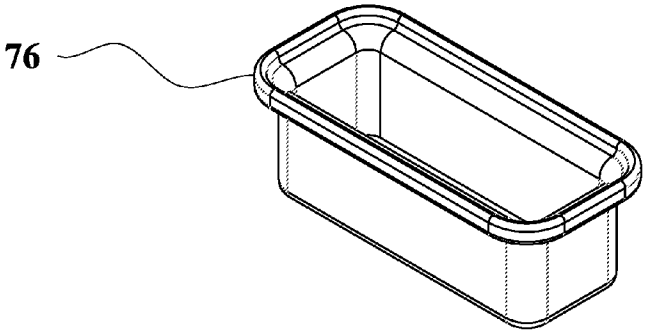
FIG. 30 is a perspective detail view of a removable container of the fifth preferred embodiment of the invention.
Figure 31:
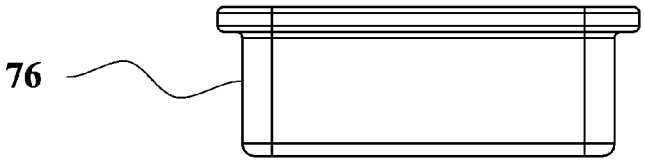
FIG. 31 is a front elevational detail view of a removable container of the fifth preferred embodiment of the invention.
Figure 32:
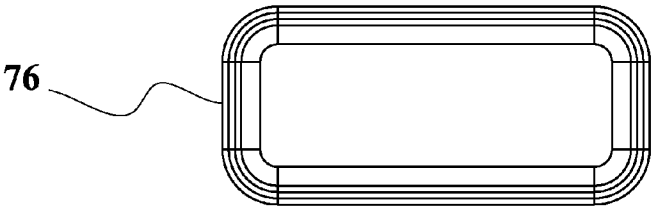
FIG. 32 is a top detail view of a removable container of the fifth preferred embodiment of the invention.
Figure 33:
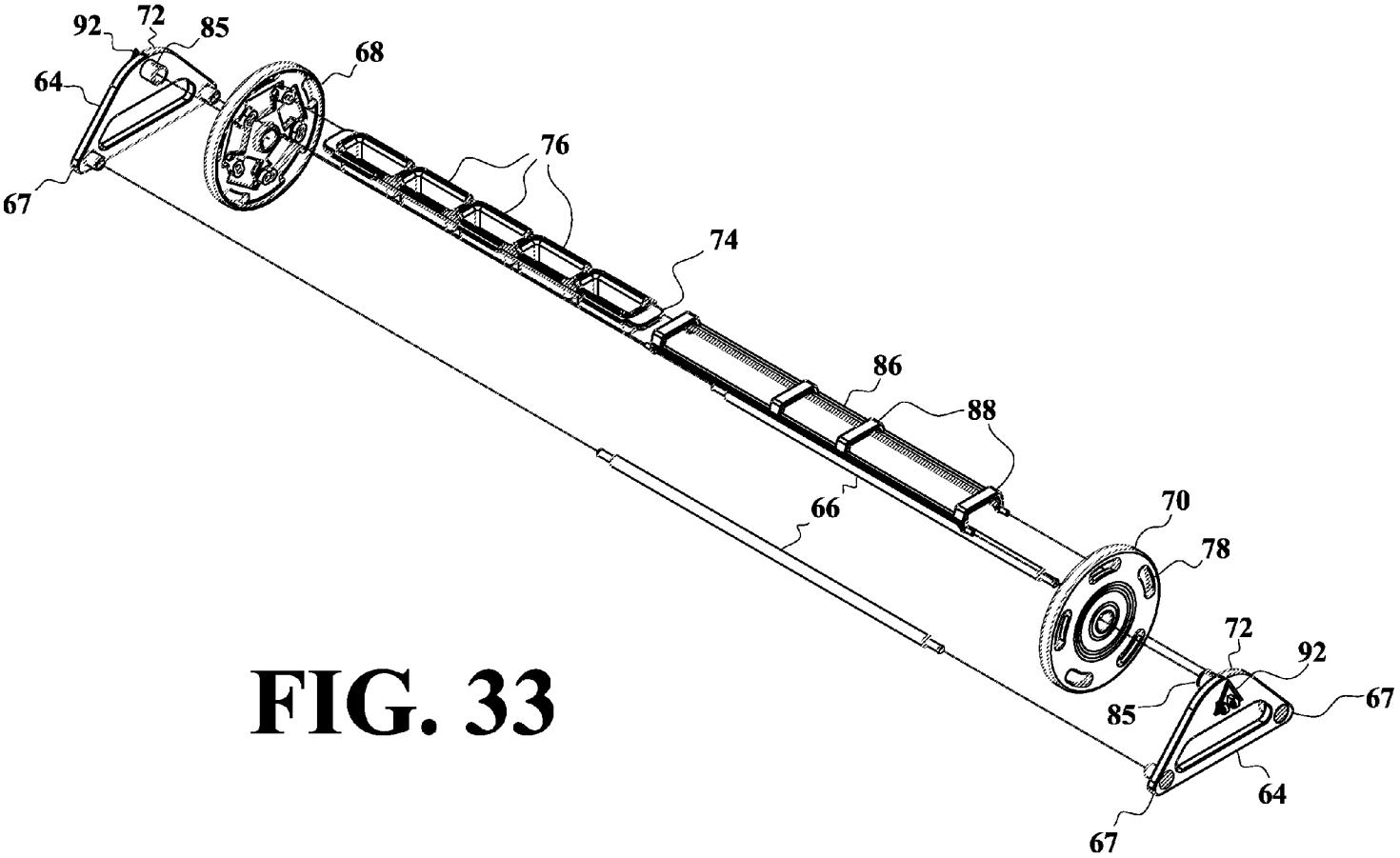
FIG. 33 is an exploded perspective view of the fifth preferred embodiment of the invention, with the right end facing forward.
Figure 34:
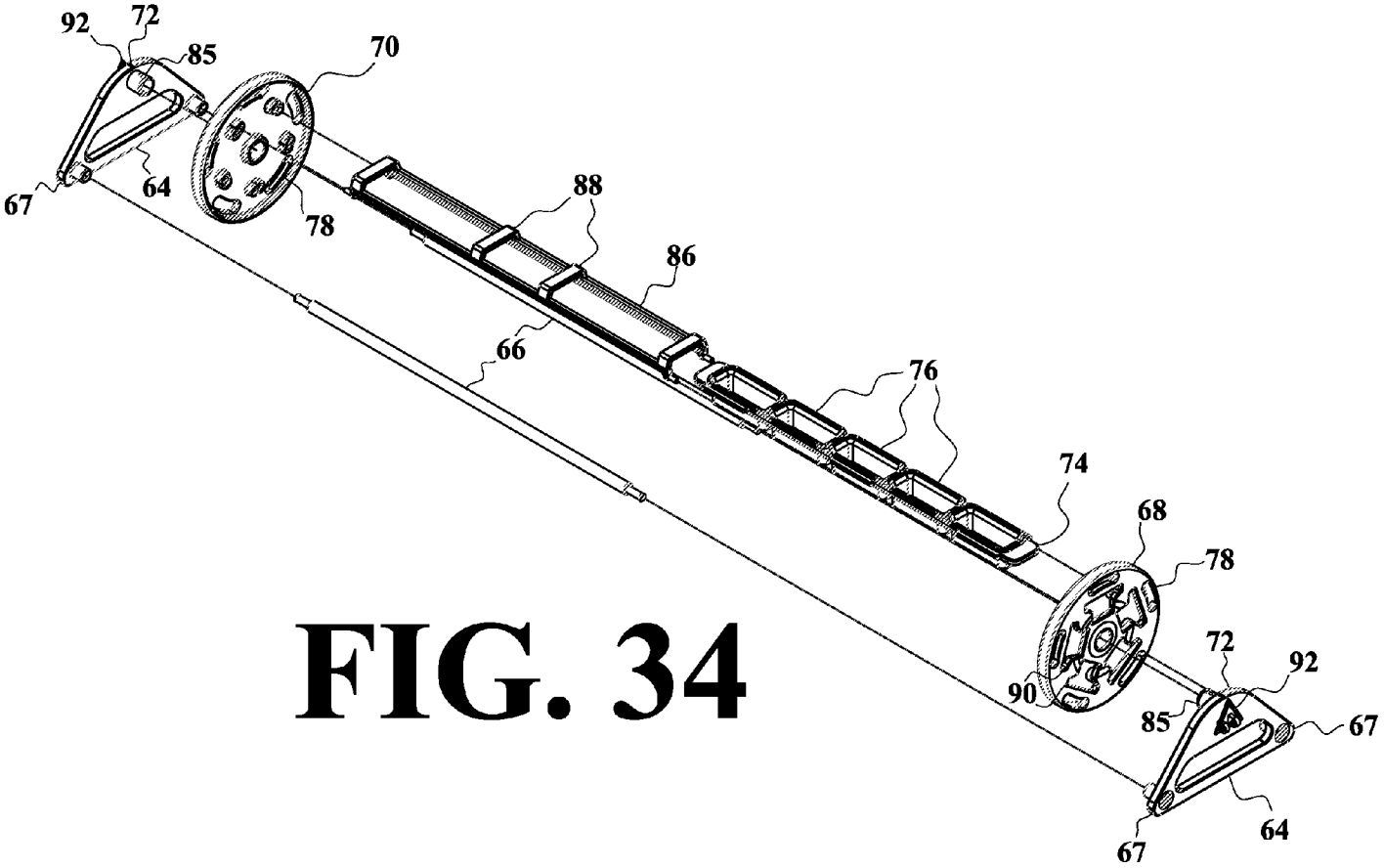
FIG. 34 is an exploded perspective view of the fifth preferred embodiment of the invention, with the left end facing forward.

FIG. 24 is a perspective view of the fifth preferred embodiment of the invention, with the right end facing forward. FIG. 25 is a top view of the fifth preferred embodiment of the invention. FIG. 26 is a front elevational view of the fifth preferred embodiment of the invention. FIG. 27 is a sectional view of the fifth preferred embodiment of the invention, along lines 27-27 in FIG. 26. FIG. 28 is a left side elevational view of the fifth preferred embodiment of the invention. FIG. 29 is a right side elevational view of the fifth preferred embodiment of the invention. FIG. 30 is a perspective detail view of a removable container of the fifth preferred embodiment of the invention. FIG. 31 is a front elevational detail view of a removable container of the fifth preferred embodiment of the invention. FIG. 32 is a top detail view of a removable container of the fifth preferred embodiment of the invention. FIG. 33 is an exploded perspective view of the fifth preferred embodiment of the invention, with the right end facing forward. FIG. 34 is an exploded perspective view of the fifth preferred embodiment of the invention, with the left end facing forward.

Figure 35:
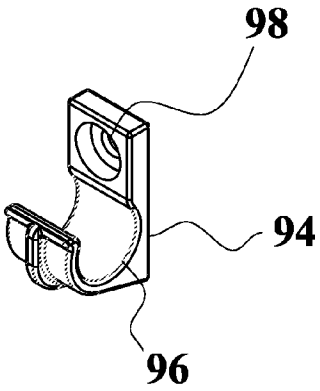
FIG. 35 is a detail perspective view of a snap clip mount, that may be used with either the fourth or fifth preferred embodiments of the invention.

FIG. 35 is a detail perspective view of a snap clip mount 94, that may be used with either the fourth or fifth preferred embodiments of the invention. Snap clip mounts may be used to removably retain the cylindrical attachment members, which can snap into hook 96. A fastener can pass through fastener hole 98 to retain the snap clip mount onto a surface. Alternatively, the invention may have a fixed mount, a clamping mount, or any other suitable fastening option.

The preferred embodiments of the invention may be used in a method of organizing items, comprising the steps of:

- attaching the mounting bracket or snap clip mounts of the organizer to one or more surfaces;
- sorting items;
- placing the items in jars or containers;
- screwing the jars to lids attached to slats, or snapping the Containers into apertures in slats; and
- rotating the slats (around the axle, if there is one) to select one of the jars.

The mounting bracket or snap clip mounts may be attached to a wall, ceiling or other surface of a building, or it may be attached to a surface of a vehicle.

It is to be understood that the present invention is not limited to the preferred embodiments described above, but encompasses any and all embodiments within the scope of the following claims.

I claim:

1. An organizer, comprising:

slats;

containers that can be retained on the slats;

two end pieces, with the slats retained between the end pieces; and two end brackets, with each of the end pieces being pivotally connected to one of the end brackets;

wherein the slats, containers and end pieces can be rotated together on the end brackets;

the slats are pivotally connected to the end pieces;

each slat has a handle by which it can be rotated independently of the end pieces or the other slats; and when the handles of the slats are not used, gravity will cause the slats and any of the containers retained on the slats to rotate on the slats' pivotal connections on the end pieces, in such a manner that open tops of the containers remain upright, the containers can be snapped into apertures in the slats to retain them on the slats.

2. The organizer according to claim 1, wherein the containers:

can he snapped out of the apertures to remove them from the slats.

3. The organizer according to claim 1, wherein:

the end brackets are generally triangular;

the end pieces are pivotally connected to the end brackets near one of three vertices of the end brackets;

there are two cylindrical attachment members that are each connected to both of the end brackets near the other two of the three vertices of the end brackets; and snap clip mounts, that can be fastened to a surface, and have hooks that can retain the cylindrical attachment members.

4. The organizer according to claim 1, wherein the end pieces are generally circular, and at least one end piece has openings that can be used as handles to turn the end pieces, the slats and the containers.

5. The organizer according to claim 1, wherein: the slats can be removed from the end pieces one of the end pieces.

* * * * *